US010451071B2

(12) United States Patent
Le et al.

(10) Patent No.: US 10,451,071 B2
(45) Date of Patent: Oct. 22, 2019

(54) FLUID PUMP FOR DISPENSING A FLUID TO A SETTING OR WORK ENVIRONMENT

(71) Applicants: Kevin Le, Richland Hills, TX (US); Thanh Le, Grand Prairie, TX (US)

(72) Inventors: Kevin Le, Richland Hills, TX (US); Thanh Le, Grand Prairie, TX (US)

(73) Assignee: Luraco, Inc., Arlington, TX (US)

( * ) Notice: Subject to any disclaimer, the term of this patent is extended or adjusted under 35 U.S.C. 154(b) by 0 days.

(21) Appl. No.: 15/833,510

(22) Filed: Dec. 6, 2017

(65) Prior Publication Data

US 2018/0094631 A1 Apr. 5, 2018

Related U.S. Application Data

(63) Continuation of application No. 15/237,595, filed on Aug. 15, 2016, now Pat. No. 10,302,088, which is a (Continued)

(51) Int. Cl.
*F04D 13/02* (2006.01)
*H05B 37/02* (2006.01)

(Continued)

(52) U.S. Cl.
CPC ..... *F04D 13/024* (2013.01); *F04D 13/026* (2013.01); *F04D 13/0633* (2013.01);

(Continued)

(58) Field of Classification Search
CPC .. F04D 13/027; F04D 13/0633; F04D 13/064; F04D 13/025; F04D 13/026;

(Continued)

(56) References Cited

U.S. PATENT DOCUMENTS 2,506,886 A 5/1950 Okulitch et al.
2,545,422 A 3/1951 Blom (Continued)

FOREIGN PATENT DOCUMENTS

CA 1286755 C 7/1991
CN 203396450 U 1/2014

(Continued)

OTHER PUBLICATIONS

ANS Gspa F Pedicure Spa (http://buynailsdirect.com/nails-salon-pedicure-spas/glass-sink-spas/ans-gspa-f-pedicure-spa.html), Aug. 15, 2016.

(Continued)

*Primary Examiner* — Dominick L Plakkoottam
(74) *Attorney, Agent, or Firm* — Hoang Steve Ngo

(57) ABSTRACT

A fluid pump for dispensing a fluid to a setting or work environment is disclosed. A fluid pump having a contactless, fluid sensor and for use with a liner is also disclosed. The pump includes a jet assembly, a motor assembly, and a contactless, fluid sensor. The pump may further include a mounting housing member, a gasket or seal, and a liner when a liner is not already present. The jet assembly is coupled to or secured about the motor assembly. The jet assembly includes a jet assembly housing, and preferably also includes a printed circuit board (PCB), a PCB cover, a shaft assembly, and an impeller. The jet assembly housing includes a base, a top cover, an impeller-receiving chamber, at least one inlet aperture, and at least one outlet aperture. A pump apparatus that includes a pump as described, a power source, and/or a control apparatus is further disclosed.

30 Claims, 21 Drawing Sheets

Related U.S. Application Data continuation-in-part of application No. 13/923,364, filed on Jun. 20, 2013, now Pat. No. 9,926,933.

(51) Int. Cl.

| | |
|---|---|
| ***F21V 19/00*** | (2006.01) |
| ***F04D 29/42*** | (2006.01) |
| ***F04D 15/02*** | (2006.01) |
| ***F04D 29/66*** | (2006.01) |
| ***F04D 29/62*** | (2006.01) |
| ***F04D 29/08*** | (2006.01) |
| ***F04D 29/047*** | (2006.01) |
| ***F04D 29/046*** | (2006.01) |
| ***F04D 13/06*** | (2006.01) |
| ***F04D 25/02*** | (2006.01) |
| *F21Y 115/10* | (2016.01) |
| *A61H 33/00* | (2006.01) |

(52) U.S. Cl.

CPC ..... *F04D 25/026* (2013.01); *F04D 29/047* (2013.01); *F04D 29/0465* (2013.01); *A61H 33/0091* (2013.01); *A61H 2033/0083* (2013.01); *A61H 2201/1207* (2013.01); *F04D 13/064* (2013.01); *F05B 2240/14* (2013.01); *F05B 2240/50* (2013.01); *F21V 19/003* (2013.01); *F21Y 2115/10* (2016.08)

(58) Field of Classification Search

CPC . F04D 13/12; F04D 1/00; F04D 25/06; F04D 29/026; F04D 29/0413; F04D 29/0473; F04D 29/048; F04D 29/049; F04D 29/605

See application file for complete search history.

(56) References Cited

U.S. PATENT DOCUMENTS

| | | | | |
|---|---|---|---|---|
| 2,951,689 | A | 9/1960 | Asp et al. | |
| 2,958,517 | A | 11/1960 | Harker et al. | |
| 3,089,514 | A | 5/1963 | Sudmeier | |
| 3,198,125 | A | 8/1965 | Yuza et al. | |
| 3,299,819 | A | 1/1967 | McCoy | |
| 3,411,450 | A | 11/1968 | Clifton | |
| 3,572,651 | A | 3/1971 | Harker | |
| 3,630,645 | A | 12/1971 | Eheim | |
| 3,932,068 | A | 1/1976 | Zimmermann | |
| 3,941,517 | A | 3/1976 | Miyahara | |
| 4,082,380 | A * | 4/1978 | Klaus | F04D 29/0413 384/425 |
| 4,115,040 | A | 9/1978 | Knorr | |
| 4,135,863 | A * | 1/1979 | Davis | H02K 49/106 417/420 |
| 4,226,574 | A | 10/1980 | Villette | |
| 4,304,532 | A * | 12/1981 | McCoy | F16J 15/50 310/104 |
| 4,312,752 | A | 1/1982 | Malik | |
| 4,331,496 | A | 5/1982 | Orndorff, Jr. | |
| 4,513,735 | A | 4/1985 | Friedson et al. | |
| 4,523,580 | A | 6/1985 | Tureaud | |
| 4,569,337 | A | 2/1986 | Baumann et al. | |
| 4,606,698 | A | 8/1986 | Clausen et al. | |
| 4,716,605 | A | 1/1988 | Shepherd et al. | |
| 4,875,497 | A | 10/1989 | Worthington | |
| 4,982,606 | A | 1/1991 | Adamski et al. | |
| 5,145,323 | A | 9/1992 | Farr | |
| 5,238,369 | A | 8/1993 | Farr | |
| 5,245,221 | A | 9/1993 | Schmidt et al. | |
| 5,414,878 | A | 5/1995 | Booth | |
| 5,458,459 | A | 10/1995 | Hubbard et al. | |
| 5,587,023 | A | 12/1996 | Booth | |
| 5,980,112 | A | 11/1999 | Matthews | |
| 5,992,447 | A | 11/1999 | Miller et al. | |
| 6,732,387 | B1 | 5/2004 | Waldron | |
| 6,997,688 | B1 | 2/2006 | Klein et al. | |
| 7,108,202 | B1 | 9/2006 | Chang | |
| 7,111,334 | B2 | 9/2006 | Chen | |
| 7,168,107 | B2 | 1/2007 | Gruenwald | |
| 7,393,188 | B2 | 7/2008 | Lawyer et al. | |
| 7,432,725 | B2 | 10/2008 | Sieh et al. | |
| 7,440,820 | B2 | 10/2008 | Gougerot et al. | |
| 7,574,756 | B2 | 8/2009 | Tran | |
| 7,593,789 | B2 | 9/2009 | Gougerot et al. | |
| 8,214,937 | B2 | 7/2012 | Lawyer et al. | |
| 8,296,874 | B2 | 10/2012 | Galati, Jr. et al. | |
| 8,380,355 | B2 | 2/2013 | Mayleben | |
| 8,531,048 | B2 | 9/2013 | Tran et al. | |
| 8,657,583 | B2 | 2/2014 | Ward | |
| 8,662,848 | B2 | 3/2014 | Tran | |
| 8,936,444 | B2 | 1/2015 | Drechsel et al. | |
| 8,944,786 | B1 | 2/2015 | McDougall | |
| 9,220,657 | B2 | 12/2015 | Stauber et al. | |
| 9,450,475 | B2 | 9/2016 | Zumstein | |
| 9,551,343 | B2 | 1/2017 | Marks et al. | |
| 9,572,747 | B2 | 2/2017 | Tran et al. | |
| 2005/0045621 | A1 | 3/2005 | Chenier et al. | |
| 2005/0262627 | A1 | 12/2005 | Chen | |
| 2006/0096021 | A1 | 5/2006 | Hutchings | |
| 2007/0101489 | A1 | 5/2007 | Hutchings | |
| 2008/0035427 | A1 * | 2/2008 | Fowler | B25H 1/06 182/153 |
| 2008/0229819 | A1 | 9/2008 | Mayleben et al. | |
| 2009/0064406 | A1 | 3/2009 | Lawyer et al. | |
| 2009/0094736 | A1 | 4/2009 | Booth et al. | |
| 2010/0074777 | A1 * | 3/2010 | Laufer | F04D 13/12 417/420 |
| 2010/0239435 | A1 * | 9/2010 | Le | F04F 5/10 417/54 |
| 2011/0004994 | A1 | 1/2011 | Le et al. | |
| 2011/0116948 | A1 * | 5/2011 | Yi | H02K 1/148 417/410.1 |
| 2011/0211982 | A1 | 9/2011 | Marks et al. | |
| 2011/0223047 | A1 | 9/2011 | Tran et al. | |
| 2011/0253236 | A1 * | 10/2011 | Le | F04F 5/10 137/565.22 |
| 2011/0305562 | A1 * | 12/2011 | Matsunaga | F04D 29/0473 415/206 |
| 2012/0045352 | A1 | 2/2012 | Lawyer et al. | |
| 2012/0156071 | A1 * | 6/2012 | Hijikata | F04D 29/048 417/423.12 |
| 2013/0022481 | A1 | 1/2013 | Schob et al. | |
| 2013/0263438 | A1 | 10/2013 | Burns et al. | |
| 2015/0005682 | A1 | 1/2015 | Danby | |
| 2015/0129039 | A1 | 5/2015 | Mulvaney | |
| 2015/0227145 | A1 | 8/2015 | Reddy et al. | |
| 2016/0097668 | A1 | 4/2016 | Vilag | |

FOREIGN PATENT DOCUMENTS

| | | | |
|---|---|---|---|
| CN | 104897239 | A | 9/2015 |
| CN | 204758082 | U | 11/2015 |
| CN | 105592834 | A | 5/2016 |
| EP | 0149132 | | 5/1989 |
| EP | 2676652 | | 12/2013 |
| EP | 2997950 | A2 | 3/2016 |
| GB | 805539 | A | 12/1958 |
| GB | 2156218 | A | 10/1985 |
| JP | H0678858 | | 3/1994 |
| JP | 2007263028 | A | 10/2007 |
| WO | WO2016059409 | A2 | 4/2016 |

OTHER PUBLICATIONS

Lexor Pedicure Spa User Manual (http://uspedicurespa.com/resources/lexor/luminous-spa-pedicure-chair-owner-manual.pdf), Aug. 15, 2016.

Maestro Pedicure Spa Owner's Manual (www.universalcompanies.com/FetchFile.ashx?id=c1571259-e567-4fcc-a079 . . . ), Aug. 15, 2016.

(56) References Cited

OTHER PUBLICATIONS

ANS Magnet Liner Jet (ALJ) Pedicure Spa Jet—Complete Set (http://buynailsdirect.com/ans-liner-jet-all-pedicure-spa-jet-complete-set.html), Aug. 15, 2016.
Auto-Fill Sensor 2.15 (https://lexor.com/Store/Product/Auto-Fill-Sensor-2-15), Aug. 15, 2016.
SpaEquip User Manual (which contains the Sanijet Pipeless Hydrotherapy, Pipeless Whirlpool Foot Bath Owner's Manual for Model: FB2-S115), revised Sep. 2004.
Petra Collection Owner's Manual (which contains instructions for Sanijet-Pipeless System users), last updated Oct. 19, 2004, and copyright 2005.
Hanning document titled "Drain Pumps Synchronous Drain Pumps DPS/DPO," downloaded Aug. 24, 2016.

* cited by examiner

FLUID PUMP FOR DISPENSING A FLUID TO A SETTING OR WORK ENVIRONMENT

CROSS-REFERENCE TO RELATED APPLICATIONS

The present application is a continuation application of and claims the priority benefit of U.S. Nonprovisional patent application Ser. No. 15/237,595, filed Aug. 15, 2016, which is a continuation-in-part application of and claims the priority benefit of U.S. Nonprovisional patent application Ser. No. 13/923,364, filed Jun. 20, 2013, both of which are incorporated herein by reference in their entireties.

BACKGROUND OF THE INVENTION

Field of the Invention

The present invention generally relates to spa devices, components, and systems. More specifically, the present invention is directed to a fluid pump for dispensing a fluid to a setting or work environment. In addition, the present invention is directed to a fluid pump having a contactless, fluid sensor for dispensing a fluid to a setting or work environment and for use with a liner, to a fluid pump apparatus comprising a fluid pump having a contactless, fluid sensor for dispensing a fluid to a setting or work environment and for use with a liner, and to a method for dispensing a fluid to a setting or work environment by use of a fluid pump having a contactless, fluid sensor for use with a liner.

Description of the Related Art

Spa devices, components, and systems are known in the art. Spa devices are used in commercial and recreational settings for hydrotherapy, massage, stimulation, pedicure, and bathing purposes. In the spa application setting, the issues with sanitization in the spa industry today require the use of a liner, such as a disposable liner. But with a liner, traditional water sensors in spa devices and settings, such as foot spas, will not be able to effectively detect fluids or water anymore. Thus, there exists a need for a fluid pump having a contactless, fluid sensor adapted for use with a liner for dispensing a fluid to a setting or work environment such that fluid or water level can be effectively detected in a setting or work environment, such as, but not limited, a foot spa, a spa, a jacuzzi, a bathtub, or a swimming pool.

Further, because typical spa devices have extensive piping systems that are built into the spa device to transport water, the spa devices are traditionally difficult to clean. This results in downtime and complicated maintenance schedules to clean such spa devices. Furthermore, if a spa device has a light source associated with it, to replace or repair such a light source can be time consuming and complicated when the light source is not easily accessible.

In the spa environment, water is commonly added with certain substances and/or products, such as salt, chemicals, sand, massage lotions, etc. Due to this reason, traditional bearings, such as ball bearings and metal bushings, will not be suitable for a long term and reliable operation. The presence of chemicals and sand, for example, will cause some or many currently available bearings to wear out quicker than normal and result in fluid pump failures.

Additionally, for magnetic coupling-type pumps, it is almost impossible to have a perfect alignment between the motor shaft axis and the impeller rotation axis. The imperfect alignment or misalignment will result in high vibration noise.

The present invention overcomes one or more of the shortcomings of the above described spa devices, components, and systems. The Applicant is unaware of inventions or patents, taken either singly or in combination, which are seen to describe the present invention as claimed.

SUMMARY OF THE INVENTION

The present invention is directed to a fluid pump for dispensing a fluid to a setting or work environment.

In one exemplary aspect, the present invention is directed to a fluid pump having a contactless, fluid sensor for dispensing a fluid to a setting or work environment and for use with a liner. The fluid pump comprises a jet assembly, a motor assembly, and a contactless, fluid sensor assembly with a contactless, fluid sensor. The fluid pump may further comprise a mounting housing member or coupling device, a gasket or seal, and a liner when a liner is not already present.

In another exemplary aspect, the present invention is directed to a fluid pump apparatus comprising a fluid pump having a contactless, fluid sensor for dispensing a fluid to a setting and for use with a liner. In addition to comprising the fluid pump, the fluid pump apparatus further comprises a power source for providing power to the fluid pump, and/or a control apparatus.

The jet assembly is secured, attached or coupled to the motor assembly.

In a non-limiting embodiment, the jet assembly includes a jet assembly housing, and preferably also includes a printed circuit board (PCB), a PCB cover, a shaft assembly, and an impeller.

The jet assembly housing includes a base, a front or top cover, an impeller-receiving chamber defined by the base and front or top cover, at least one inlet aperture dimensioned and configured to allow a fluid to enter the jet assembly housing, and at least one outlet aperture dimensioned and configured to allow the fluid to exit or be dispensed from the jet assembly housing into a setting.

The shaft assembly includes at least the shaft member.

The impeller, preferably a magnetic impeller, is configured to rotate about the shaft member and to rotate within the impeller-receiving chamber such that rotation of the impeller causes fluid to enter or flow into the inlet aperture and to exit or flow out of the outlet aperture.

The motor assembly may include and/or be coupled to the power source that enables rotation of the motor shaft member and impeller.

The contactless, fluid sensor assembly includes a contactless, fluid sensor or sensor circuit board, and may also include a sensor cover and a sensor output data cable.

The contactless, fluid sensor may be secured, attached, fixed or mounted to any position on the other components of the fluid pump, such as, but not limited to, the mounting housing member or coupling device, or even be positioned at a location away from the fluid pump, that allows the sensor to be in operative communication with the other components of the fluid pump whereby the contactless, fluid sensor is effective, especially when a liner is being used in or with the setting, in capacitive sensing of fluid or water level in the setting such that the amount or volume of fluid or water can be controlled.

In a further exemplary aspect, the present invention is directed to a method for dispensing a fluid to a setting by use of a fluid pump having a contactless, fluid sensor adapted for use with a liner.

Figure 1:
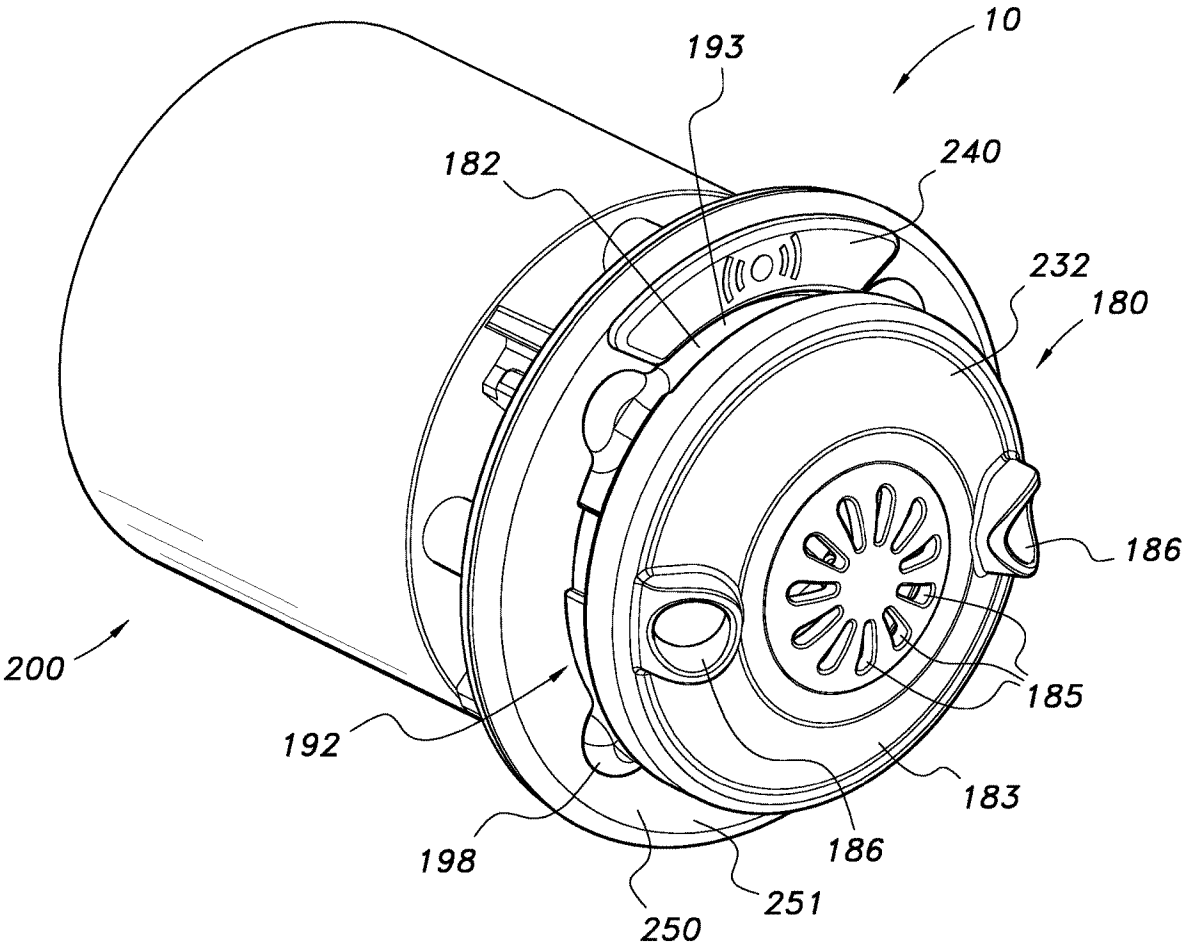
FIG. 1 is a front, right side, perspective view of a fluid pump having a contactless, fluid sensor according to the present invention, showing a jet assembly and a motor assembly secured or coupled to or about one another.

It should be understood that the above-attached figures are not intended to limit the scope of the present invention in any way.

DETAILED DESCRIPTION OF THE PREFERRED EMBODIMENTS

The present invention is directed to a fluid pump for dispensing a fluid to a setting or work environment. Referring to FIGS. 1-22, the present invention is directed to a fluid pump 10,300, preferably a magnetic, coupling-type pump, having a contactless, fluid sensor 241 for dispensing a fluid to a setting SET or work environment, such as, but not limited, to a foot spa, a spa, a jacuzzi, a bathtub, or a swimming pool, and for use with a liner 290. The setting SET or work environment may be preferably be in manicure and pedicure industries and similar industries. The fluid pump 10 comprises a jet assembly 180, a motor assembly 200, and a contactless, fluid sensor assembly 240 having a contactless, fluid sensor 241. The fluid pump 10 may further comprise a mounting housing member or coupling device 250, a gasket or seal 265, and/or a liner 290 when a liner is not already provided or present. In addition, the present invention is also directed to a fluid pump apparatus 1. Besides comprising the fluid pump 10, the fluid pump apparatus 1 further comprises a power source 400 for providing power to the fluid pump 10, and/or a control apparatus 410.

The jet assembly 180 is secured, attached or coupled to the motor assembly 200, and this may be accomplished by various means. As a non-limiting example and as shown in FIGS. 1-4, the jet assembly 180 is secured, attached or coupled to or about the motor assembly 200 by the assistance of the mounting housing member 250.

As a non-limiting example and as best shown in FIGS. 4 and 7-16, the jet assembly 180 preferably includes: a jet assembly housing 181 that has a printed circuit board (PCB) 270 and a PCB cover 280; a shaft assembly 140; and an impeller 170. As an alternative, the jet assembly 180 may be substituted with the jet assembly 180'. As shown in FIGS. 8-18, the jet assembly 180' includes: a jet assembly housing 181 that does not have the PCB 270 nor the PCB cover 280; a bearing and shaft assembly 100; and an impeller 170.

As shown in FIGS. 1, 3A-5, 7, 10 and 14-16, the jet assembly housing 181 includes a base 182, a front or top cover 183, an impeller-receiving chamber 184 defined by the base 182 and front or top cover 183, a plurality of inlet apertures 185 dimensioned and configured to allow a fluid to enter the jet assembly housing 181 and preferably disposed about the central area of the front or top cover 183, and a plurality of outlet apertures 186 dimensioned and configured to allow the fluid to exit or be dispensed from the jet assembly housing into the setting SET and preferably disposed about the periphery of the front or top cover 183.

Figure 3A:
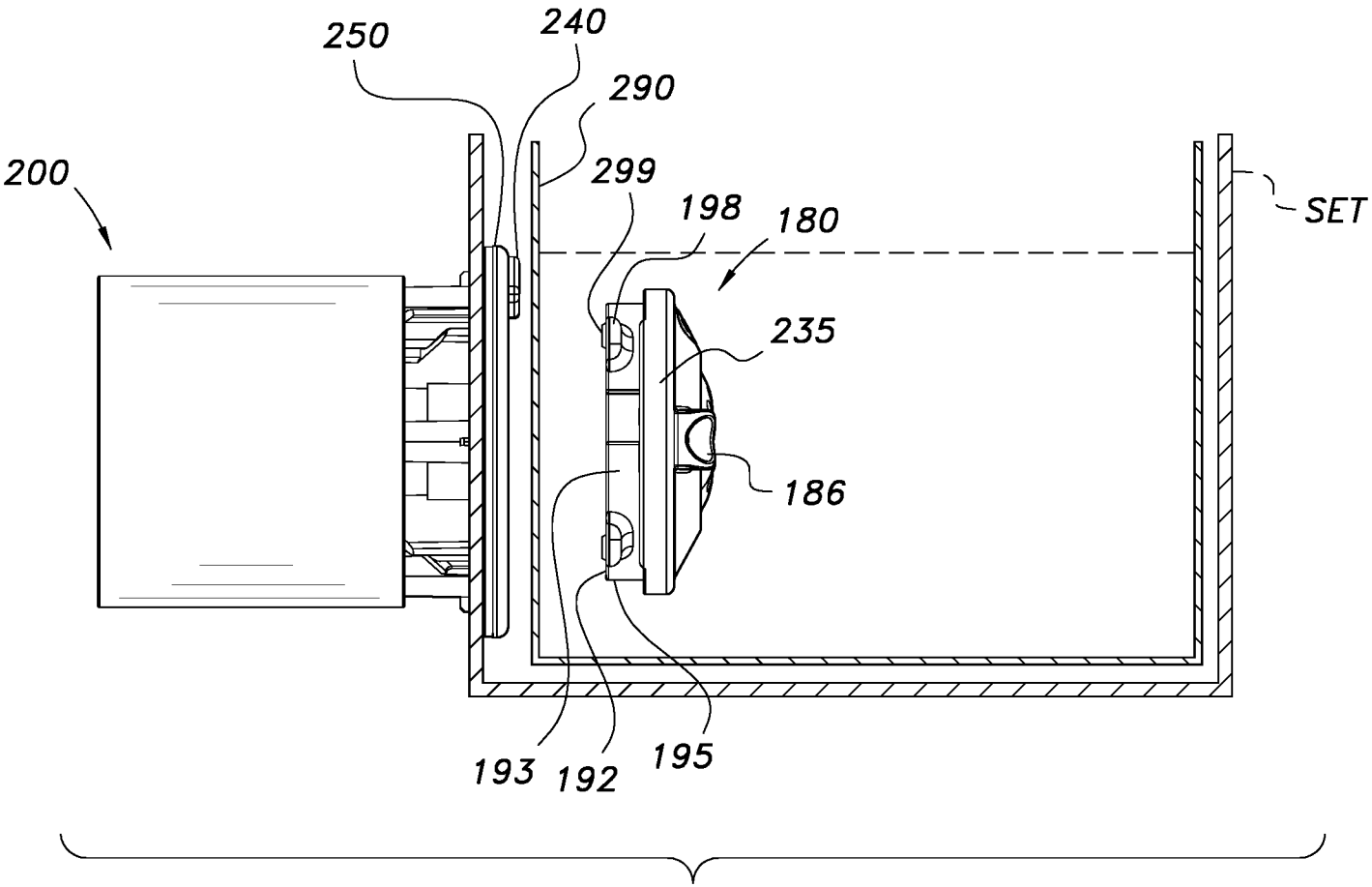
FIG. 3A is a right side, partial cross-sectional, environmental view of the fluid pump of FIG. 1, wherein the motor assembly is secured to or proximate to a setting, such as an internal wall of a foot spa, while the jet assembly will be secured or coupled to or about the motor assembly prior to operation or use, wherein a liner will be positioned between the motor assembly and jet assembly prior to operation or use, and wherein a contactless, fluid sensor is shown secured to a mounting housing member and positioned about the motor assembly and behind the liner prior to operation or use.
Figure 3B:
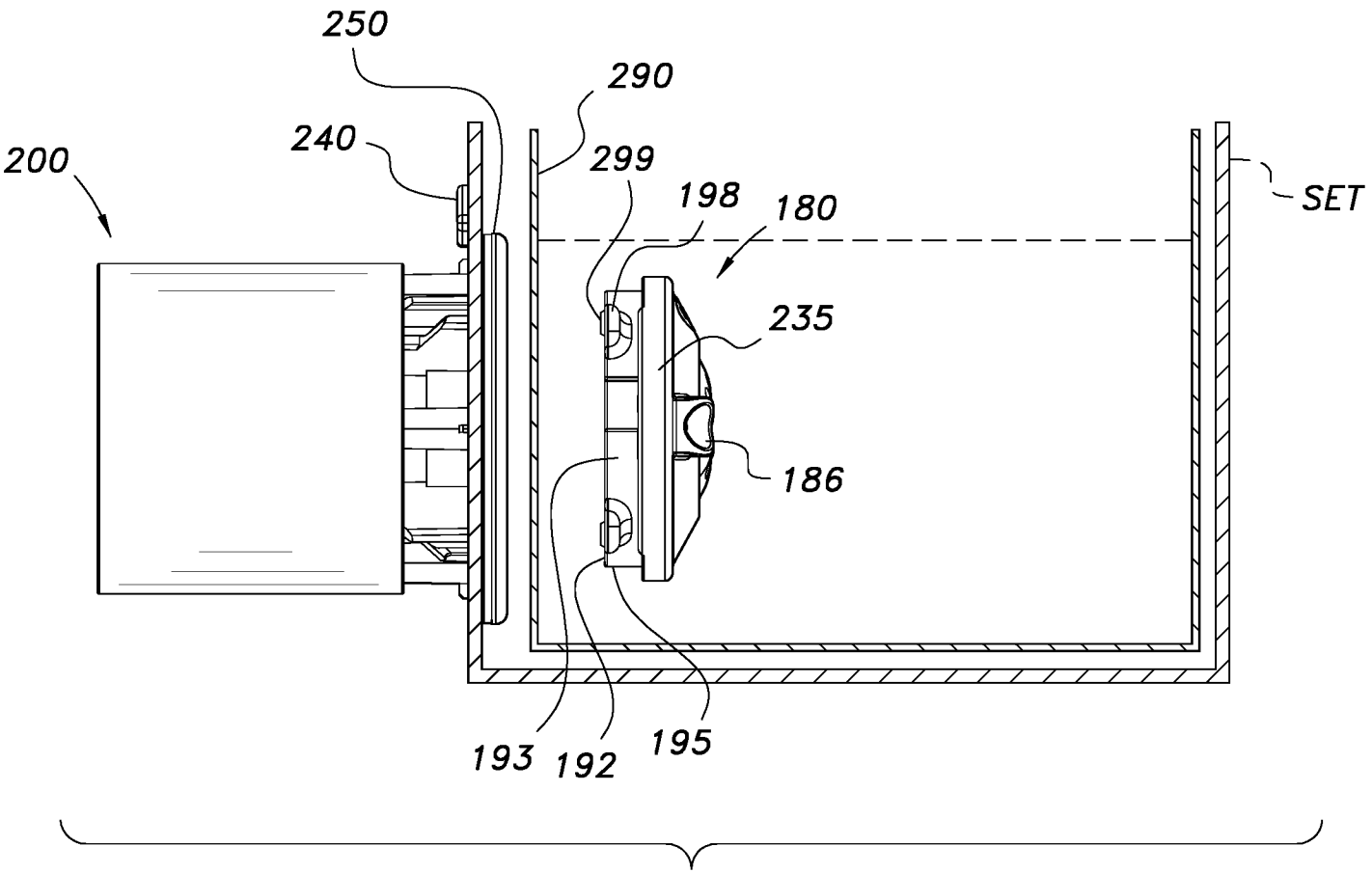
FIG. 3B is a right side, partial cross-sectional, environmental view of another embodiment of a fluid pump having a contactless, fluid sensor according to the present invention, showing a jet assembly and a motor assembly secured or coupled to or about one another, wherein the motor assembly is secured to or proximate to a setting, such as an internal wall of a foot spa while the jet assembly will be secured or coupled to or about the motor assembly prior to operation or use, wherein a liner will be positioned between the motor assembly and jet assembly prior to operation or use, and wherein a contactless, fluid sensor is shown secured behind the internal wall of a foot spa and positioned about the motor assembly and behind the liner prior to operation or use.

As best shown in FIGS. 4, 10 and 14-16, the base 182 of the jet assembly housing 181 has an inner surface 191, an outer surface 192, a circular wall 193 at or about the periphery of the base 182, a plurality of feet extensions 198, and a plurality of engagement recesses or grooves 199. Preferably, the outer surface 192 is generally flat or has a generally flat, centrally-located section 557 that allows for a liner 290 to be positioned behind (or below) the base 182 of the jet assembly housing 181 and in front of (or above) the contact surface of the setting SET and motor assembly 200, as shown in FIGS. 3A and 3B. The circular wall 193 has an inner surface 194, an outer surface 195, a front or top 196, and a rear or bottom 197. Each of the plurality of feet extensions 198 extends outwardly from about the rear or bottom 197 of the circular wall 193, and has a knob 299 extending rearwardly or downwardly from the corresponding feet extension 198 for engaging with the mounting housing member 250. Each of the plurality of engagement recesses or grooves 199 is positioned at a predetermined location about the outer surface 195 of the circular wall 193 for engaging with and securing the front or top cover 183. The base 182 may be made or manufactured of plastic, hard plastic, and/or any other suitable material known to one of ordinary skill in the art.

As best shown in FIGS. 1, 4, 7, 14 and 16, the front or top cover 183 of the jet assembly housing 181 has an inner surface 231, an outer surface 232, a circular wall 233 at or about the periphery of the front or top cover 183, a plurality of engagement protrusions 238, and a lock-receiving cavity 239. The circular wall 233 has an inner surface 234, an outer surface 235, a front or top 236, and a rear or bottom 237. Each of the plurality of engagement protrusions 238 is positioned at a predetermined location about the inner surface 234 of the circular wall 233 for engaging with a corresponding engagement recess or groove 199 of the base 182 such that the base 182 and front or top cover 183 may be detachably secured to one another prior to and during operation or use and also may be detachably unsecured from one another after operation or use for allowing access to the components, maintenance, etc. The lock-receiving cavity 239 is configured and positioned at a predetermined location about the inner surface 231 of the front or top cover 183 such that the lock-receiving cavity 239 receives the tip of the shaft member 150 (or locking mechanism 159') when the base 182 and front or top cover 183 are detachably secured to one another prior to and during operation or use. The front or top cover 183 may be made or manufactured of plastic, hard plastic, and/or any other suitable material known to one of ordinary skill in the art.

Preferably, the plurality of inlet apertures 185 form an outer diameter that is equal to or smaller than the outer diameter of the impeller 170.

Preferably, each of the outlet apertures 186 has a nozzle. Preferably, each of the nozzles and an axis of the fluid pump 10,300 form an angle less than 90 degree.

Figure 4:
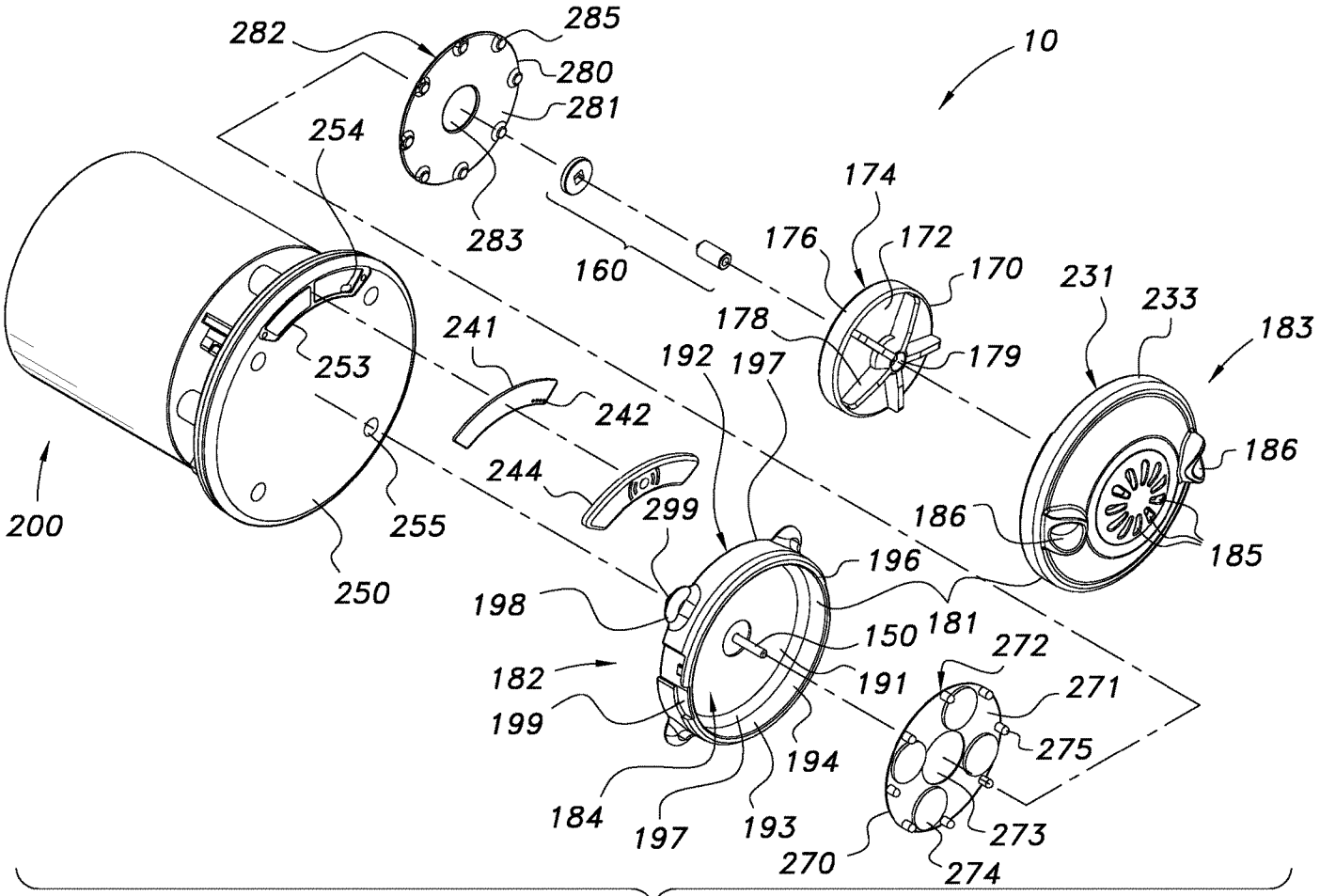
FIG. 4 is an exploded, perspective view of the fluid pump of FIG. 1.
Figure 5:
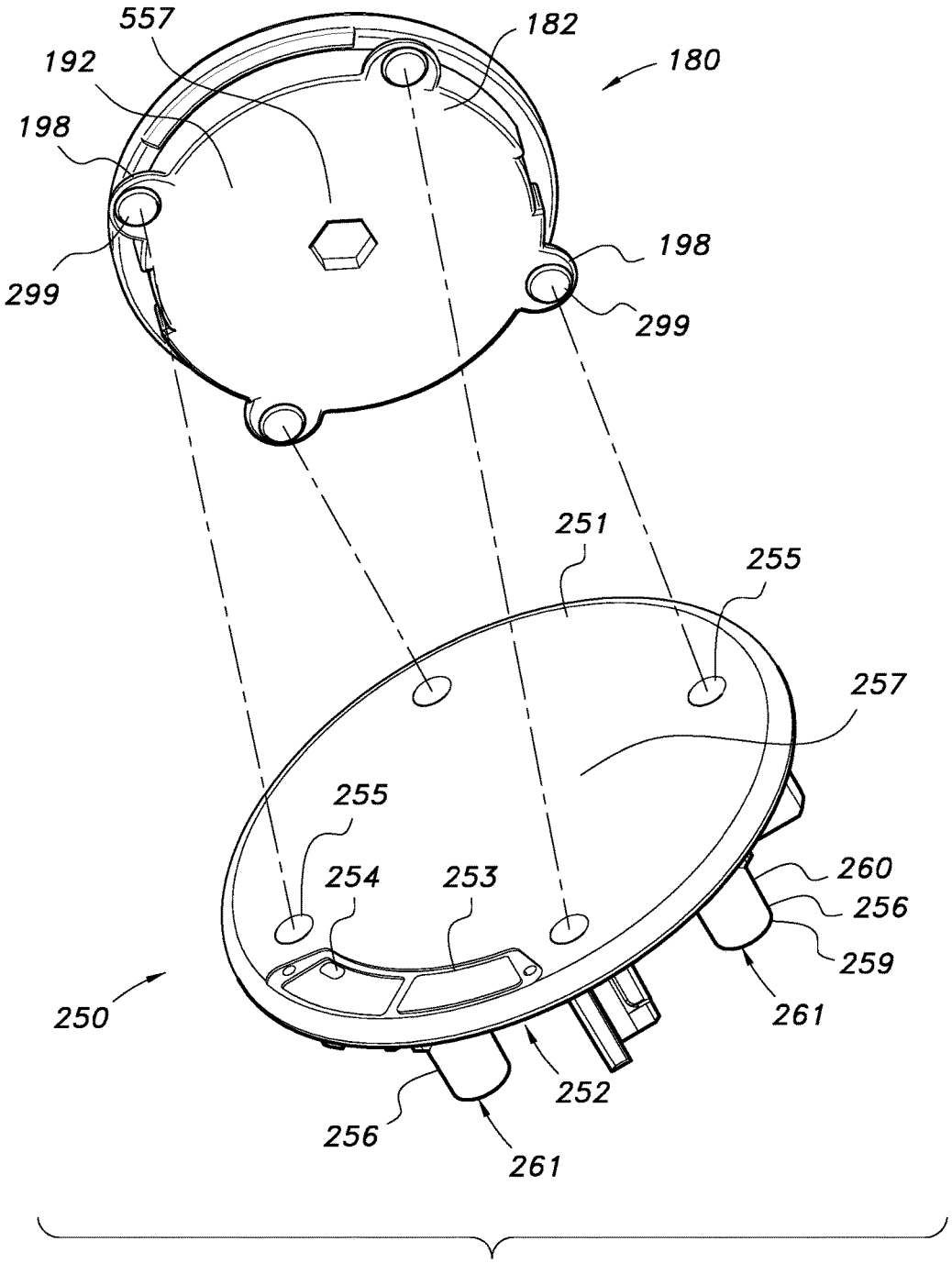
FIG. 5 is an exploded, perspective view of a jet assembly and a mounting housing member or coupling device according to the present invention.

As shown in FIG. 4, the PCB 270 of the jet assembly housing 181 has a "disc-like" configuration or shape, and includes a front or top side 271, a rear or bottom side 272, a hole 273, a plurality of inductive coils 274, and a light source 275, such as, but not limited to, a plurality of LED light members 275. The hole 273 allows the shaft member 150 to pass through, and is preferably centrally located. The plurality of inductive coils 274 are positioned at predetermined locations on the front or top side 271 proximate the hole 273. The plurality of LED light members 275 are positioned at predetermined locations on the front or top side 271 about the periphery of the PCB 270, and provide lighting or illumination to the jet assembly housing 181. The PCB 270 is secured or attached to the base 182 prior to operation or use such that the rear or bottom side 272 of the PCB 270 is adjacent or in close proximity to the inner surface 191 of the base 182. The PCB 270 may be secured or attached to the base 182 by any method known to one of ordinary skill in the art.

Preferably, the light source 275 is configured to emit a light that illuminates the first fluid, when the magnetic array 177,210 is driven. The impeller 170 causes the first fluid to flow into the the plurality of inlet apertures 185 and out the the plurality of outlet apertures 186. Illuminating the first fluid via the light source 275 includes providing energy to the light source 275 via magnetic waves captured by the inductive coils 274, which are positioned between the impeller 170 and base 182 of the jet assembly housing 181. As a non-limiting example, the parameter of the illumination includes at least one of intensity, color, illumination sequencing, and any combination thereof.

As shown in FIG. 4, the PCB cover 280 of the jet assembly housing 181 has a "disc-like" configuration or shape, and includes a front or top side 281, a rear or bottom side 282, a hole 283, and a plurality of LED light member covers 285. The hole 283 allows the shaft member 150 to pass through, and is preferably centrally located. The plurality of LED light member covers 285 are positioned at predetermined locations on the front or top side 281 about the periphery of the PCB cover 280, and are adapted for being secured or attached with corresponding LED light members 275 of the PCB 270. The PCB cover 280 is positioned upon the PCB 270 such that the rear or bottom side 282 of the PCB cover 280 is adjacent or in close proximity to the front or top side 271 of the PCB 270.

As shown in FIGS. 4, 8, 9, 10, 14, 15 and 17, the shaft assembly 140 includes the shaft member 150, the shaft protection member 160, and, preferably, the locking mechanism 159.

The shaft member 150 includes a base 152 and a cylindrical body 154 extending upwardly from the base 152. The cylindrical body 154 has a first end 156 and a second end 158. As best shown in FIG. 4, the shaft member 150 and shaft protection member 160 are secured, attached, fixed or mounted within the housing 181, preferably in a central location of the base 182 of the housing 181, of the jet assembly 180,180' via the base 152 of the shaft member 150 being secured, attached, fixed or mounted to the base 182 of the housing 181. The cylindrical body 154 has a first end 156 and a second end 158. The shaft member 150 is preferably made or manufactured of steel or a metal material. It is obvious to one of ordinary skill in the art that other suitable materials may be used in the making or manufacturing of the shaft member 150. Also, the shaft member 150 is preferably made or manufactured as a single piece. It is obvious to one of ordinary skill in the art that the shaft member 150 may be made or manufactured as multiple pieces.

Figure 8:
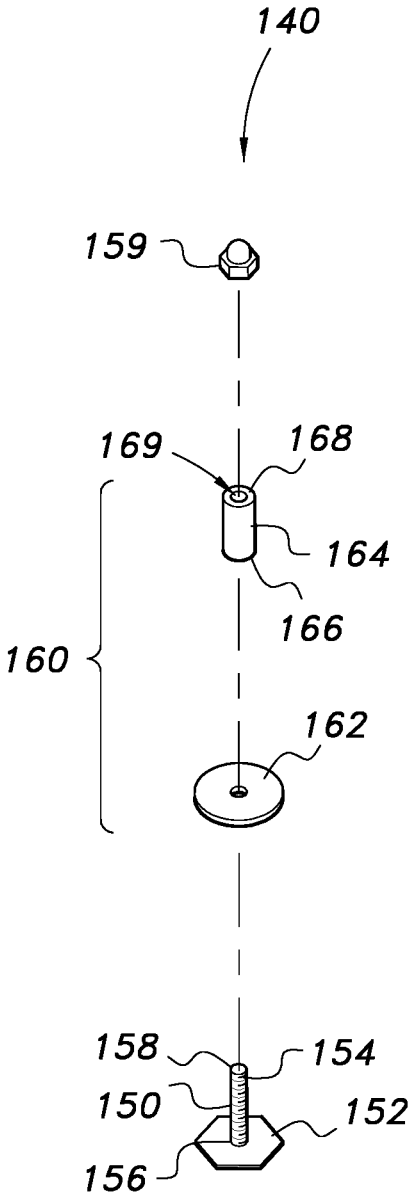
FIG. 8 is an exploded, perspective view of a shaft assembly according to the present invention.
Figure 9:
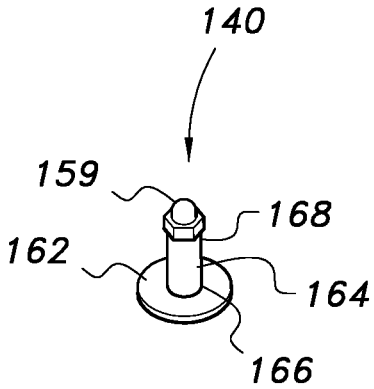
FIG. 9 is an assembly, perspective view of the shaft assembly of FIG. 8.

The shaft protection member 160 includes a base 162, preferably a ring-like base, and a cylindrical body 164 extending upwardly from the ring-like base 162. The cylindrical body 164 has a first end 166, a second end 168, and a cavity 169 extending from the first end 166 to the second end 168. As shown in FIG. 8, the cavity 169 is dimensioned and configured for receiving the cylindrical body 154 of the shaft member 150. The shaft protection member 160 is preferably made or manufactured of a hard material, such as ceramic or a ceramic-type material. It is obvious to one of ordinary skill in the art that other suitable materials may be used in the making or manufacturing of the shaft protection member 160. Also, the shaft protection member 160 is preferably polished or super smooth on its outer surface. Further, the shaft protection member 160 is preferably made or manufactured as two pieces. It is obvious to one of ordinary skill in the art that the shaft protection member 160 may be made or manufactured as a single piece.

The locking mechanism 159 secures the shaft protection member 160 within the housing 181 of the jet assembly 180,180'. The locking mechanism 159 may be a locking nut that, when in use, is secured onto the second end 158 of the cylindrical body 154 of the shaft member 150.

Figure 14:
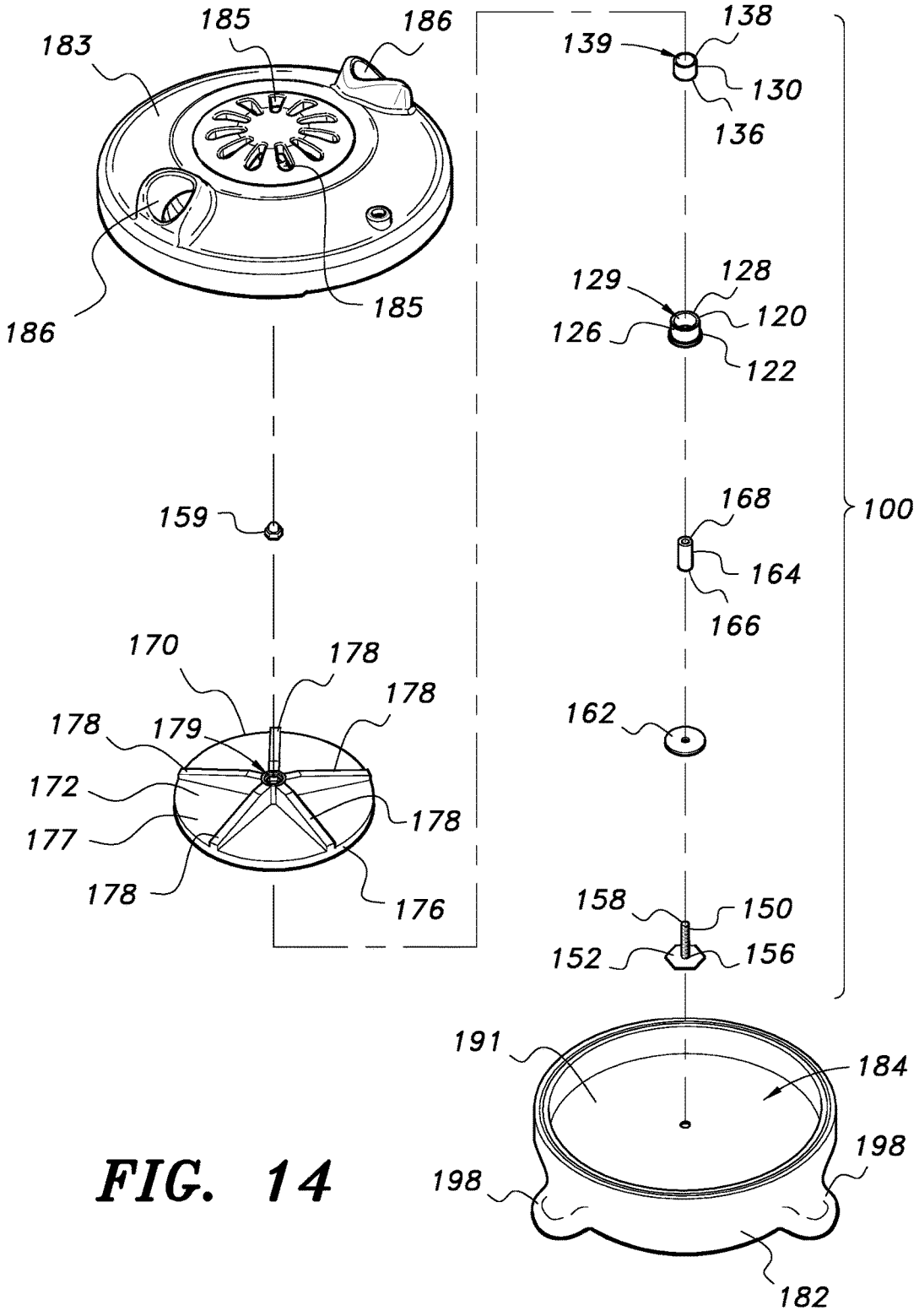
FIG. 14 is an exploded, perspective view of the bearing assembly of FIG. 11, the shaft assembly of FIG. 8, and a jet assembly (with a front or top cover)
Figure 15:
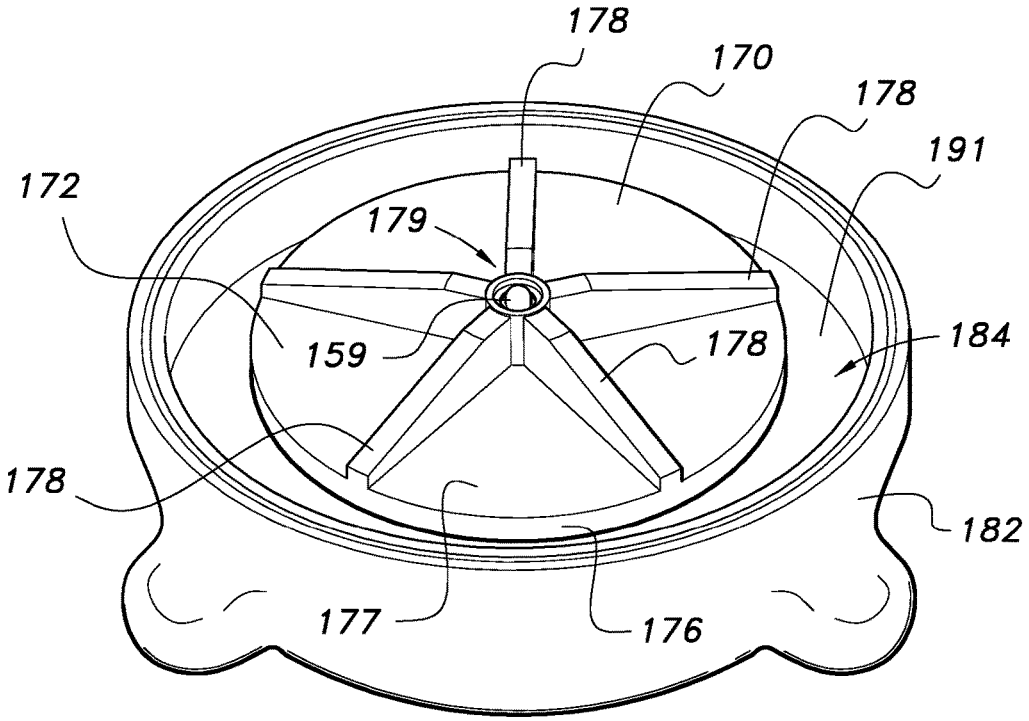
FIG. 15 is an assembly, perspective view of the bearing and shaft assembly of FIGS. 8 and 11, and the impeller and jet assembly housing of the jet assembly (without the front or top cover) of FIG. 14.
Figure 16:
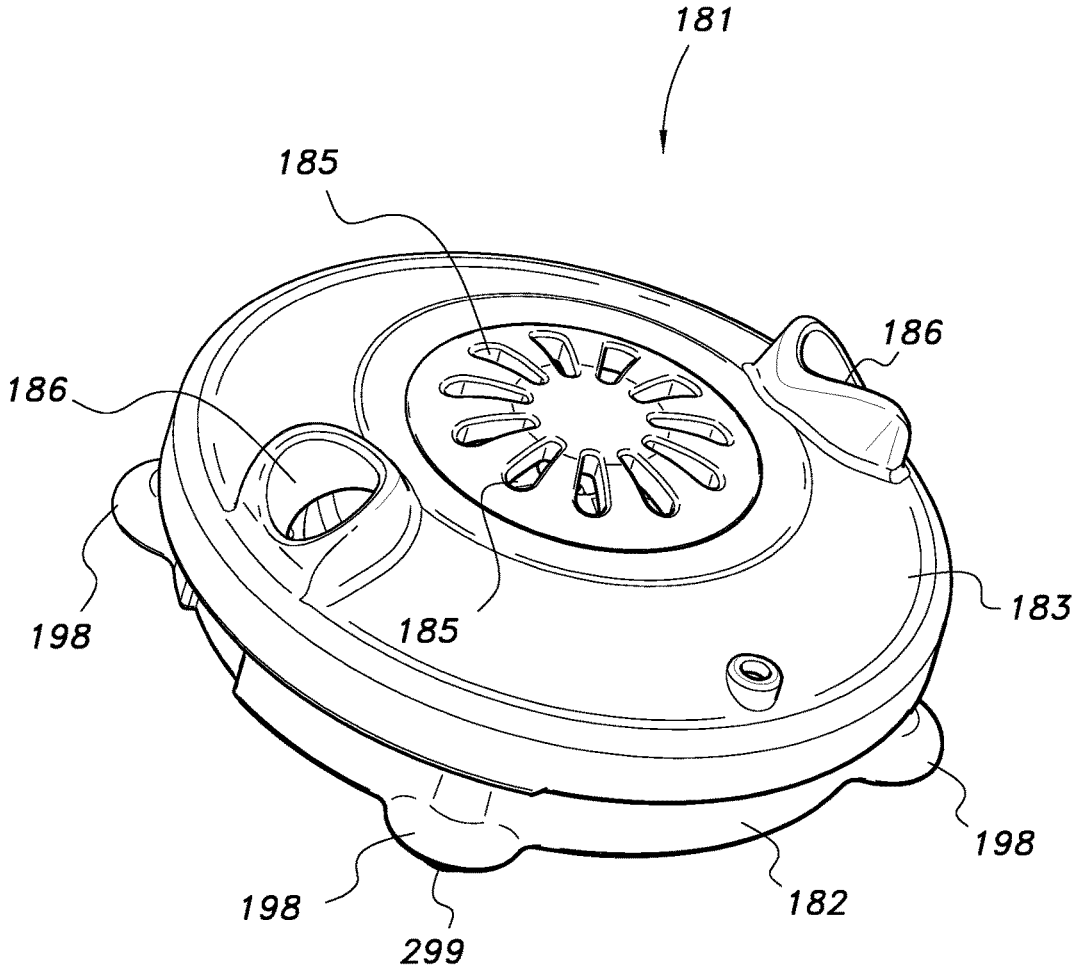
FIG. 16 is an assembly, perspective view of the bearing and shaft assembly of FIGS. 8 and 11, and the impeller and jet assembly housing of the jet assembly (with the front or top cover) of FIG. 14.
Figure 22:
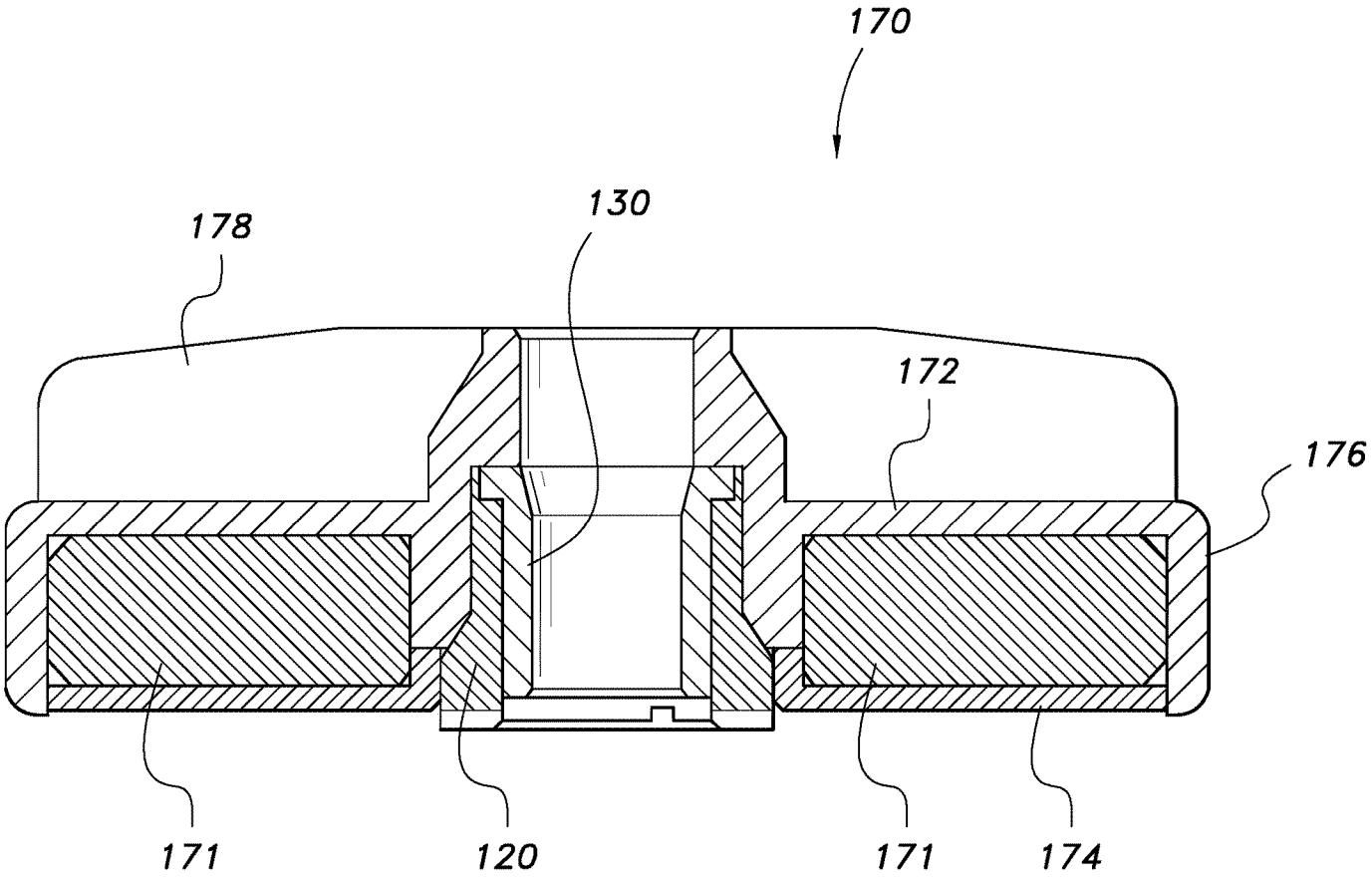
FIG. 22 is a cross-sectional view of a magnetic impeller according to the present invention.

As shown in FIGS. 4, 14 and 15, the impeller 170, preferably a magnetic impeller 170 and more preferably a planar magnetic impeller 170, has an outer diameter and a "disc-like" configuration or shape, and includes a front side 172, a rear side 174, a sidewall 176, a circular array of arm members 178 positioned on the front side 172, and the centrally-disposed cavity 179 dimensioned and configured for receiving the outer bearing member 120, inner bearing member 130, shaft member 150, and shaft protection member 160. The centrally-disposed cavity 179 preferably extends from the front side 172 through to the rear side 174. The magnetic impeller 170 is configured to rotate about the shaft member 150 and shaft protection member 160 and to rotate within the impeller-receiving chamber 184. Preferably, the magnetic impeller 170 is formed in whole or in part of a magnetic pole array 177 that, as discussed below, interacts with magnetic pole array 210 of the motor assembly 200 to rotate the magnetic impeller 170 about the shaft member 150 and shaft protection member 160 such that rotation of the magnetic impeller 170 causes the fluid to flow into the inlet aperture 185 and out the outlet aperture 186. As a non-limiting example and as shown in FIG. 22, the magnetic impeller 170 may contain a magnetic plate 171 within an exterior made or manufactured of rubber or a rubber-like material. It is obvious to one of ordinary skill in the art that the magnetic impeller 170 may be other types of magnetic impellers that is know in the art.

Figure 18A:
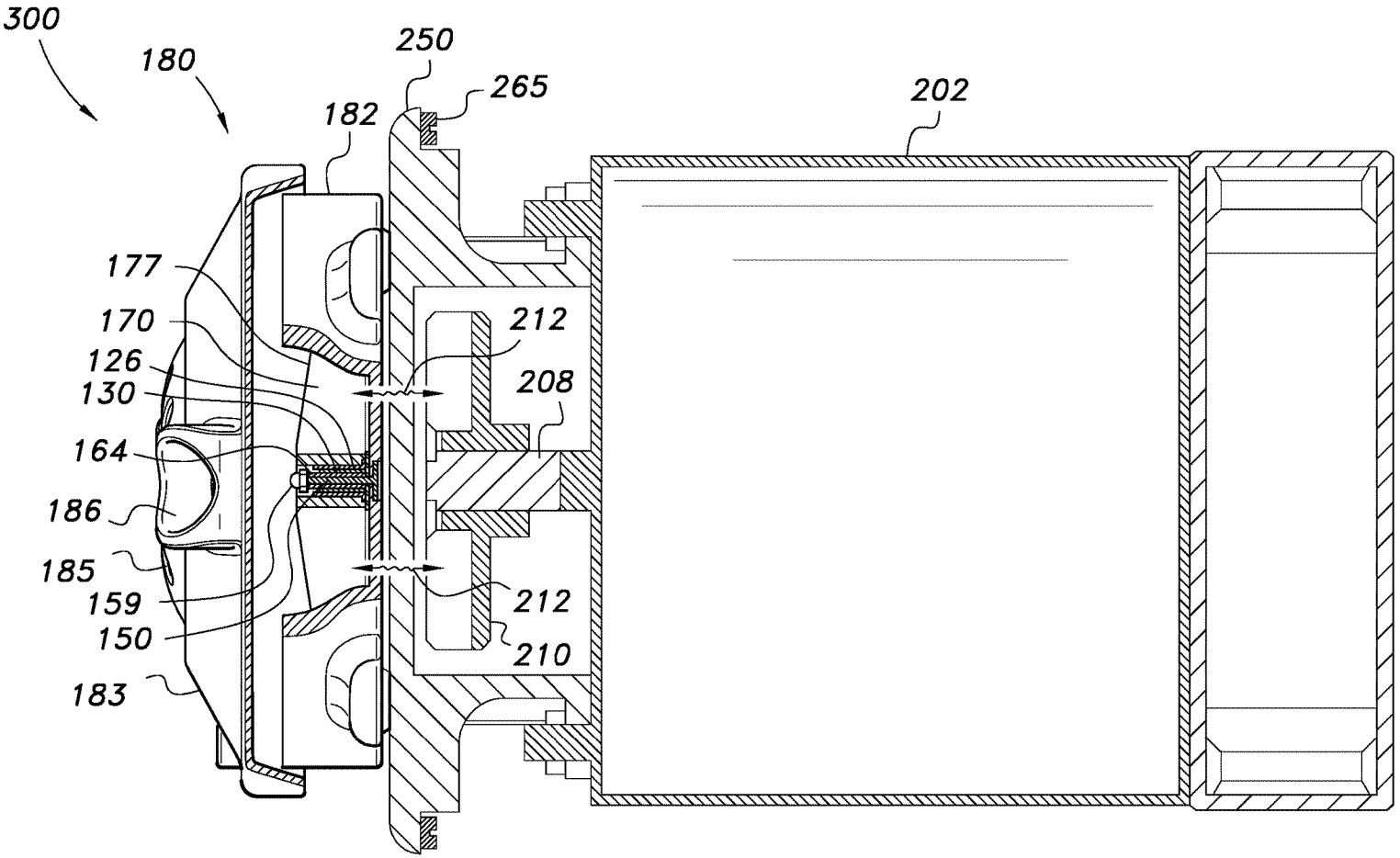
FIG. 18A is a cross-sectional view of the magnetic, coupling-type pump of FIG. 17.
Figure 18B:
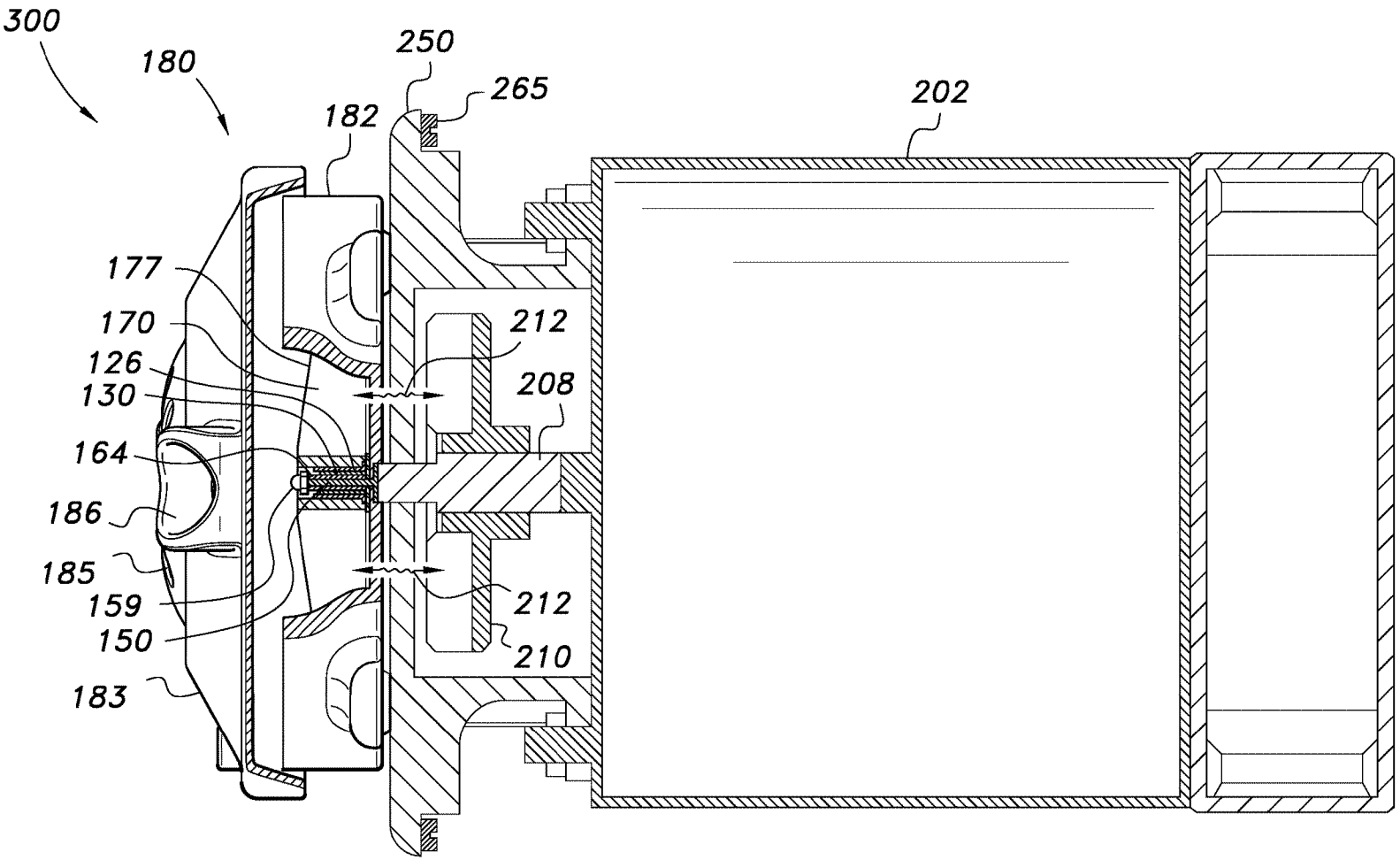
FIG. 18B is a cross-sectional view of another embodiment of a magnetic, coupling-type pump according to the present invention, showing a jet assembly and a motor assembly secured or coupled to or about one another, and not including a contactless, fluid sensor assembly nor a liner.

As best shown in FIGS. 18A and 18B, the motor assembly 200 includes a motor 202, a magnetic pole array 210 such that the motor 202 is configured to drive the magnetic pole array 210, a mounting housing member 250, a gasket 265, a motor shaft member 208 that is coupled to the magnetic pole array 210, and a plurality of screws with wing nuts 258 to support the pump mounting. The mounting housing member 250 and gasket 265 preferably enclose all or a substantial portion of the magnetic pole array 210, and help to keep fluids and/or substances away from the motor 202 and magnetic pole array 210 so that contamination and/or damage is reduced or prevented. The magnetic pole array 210 is formed of magnetic material and/or is magnetized in order to generate a magnetic field 212. As shown in FIG. 18A, the motor shaft member 208 preferably does not extend through the mounting housing member 250. Alternatively, as shown in FIG. 18B, the motor shaft member 208 extends through the mounting housing member 250.

In that regard, the motor assembly 200 may include and/or be coupled to a power source 400 that enables rotation of the motor shaft member 208 and magnetic impeller 170. Upon operation of the motor assembly 200, the motor shaft member 208 is rotated such that the magnetic field 212 generated by the magnetic pole array 210 moves or fluctuates in accordance with the rotation of the magnetic pole array 210.

Furthermore, the motor assembly 200 may further include an air channel (not shown), or air channel member (not shown). In that regard, the air channel includes an inlet (not shown) and outlet (not shown). The air channel, in part, enables the jet assembly 180,180' to produce a jet stream of fluid that includes an air mixture.

As best shown in FIGS. 1-5, the mounting housing member 250 helps to secure, attach or couple the jet assembly 180 and motor assembly 200 together, or at least in proximity of one another, such that the jet assembly 180 and motor assembly 200 are in operative communication with one another. The mounting housing member 250 includes a front (or top) side or surface 251, a rear (or bottom) side or surface 252, the sensor-receiving cavity 253 located about the periphery of the front (or top) side 251, a plurality of engagement holes or ports 255, a plurality of mounting legs 256 extending rearwardly (or downwardly) from the rear (or bottom) side 252, and at least one wing nut 258. Preferably, the front (or top) side 251 is generally flat or has a generally flat, centrally-located section 257 that allows for a liner 290 to be positioned behind (or below) the base 182 of the jet assembly housing 181 and in front of (or above) the front or top side 251 of the mounting housing member 250 and motor assembly 200, as shown in FIGS. 3A-5. Preferably, the generally flat section is at least 10% of the front (or top) side 251 for accommodating a liner 290 being positioned between the base 182 of the jet assembly housing 181 and the front (or top) side 251 of the mounting housing member 250. The sensor-receiving cavity 253 is dimensioned and configured for receiving the contactless, fluid sensor or sensor circuit board 241, and preferably has a hole or opening 254. Each of the plurality of engagement holes or ports 255 is dimensioned and configured for receiving the corresponding knob 299 that extends rearwardly or downwardly from the corresponding feet extension 198 of the base 182 of the jet assembly housing 181. The securement, attachment or engagement of the knobs 299 of the plurality of feet extensions 198 to or inside the plurality of engagement holes or ports 255 of the mounting housing member 250 prevents the rotation of the base 182 and front or top cover 183 of the jet assembly housing 181 when the fluid pump 10,300 is in operation, and thus form the jet assembly rotation locking mechanism. Each of the plurality of mounting legs 256 has a first end 259, a second end 260, and a hollow channel 261 extending from the first end 259 toward the second end 260. Each hollow channel 261 is dimensioned and configured for receiving a corresponding screw (not shown) of a plurality of screws when the motor assembly 200 is to be secured to the mounting housing member 250. Preferably, the wing nut 258 rotates to extend out to provide a lock for the securement or installation of the mounting housing member 250 to the setting SET, such as, but not limited to, a sidewall of a basin or spa. The plurality of screws and wing nut 258 secure or attach the mounting housing member 250 to the setting SET when the user screws or tightens the screws into the hollow channel 261 of the mounting legs 256 and rotates the wing nut 258. The tightening of the the screws into the hollow channel 261 of the mounting legs 256 and rotation of the wing nut 258 causes pressure to be applied to the gasket or seal 265 such that a strong seal will form between the gasket or seal 265 and contact surface of the setting SET. The mounting housing member 250 may be made or manufactured of plastic, hard plastic, and/or any other suitable material known to one of ordinary skill in the art. Preferably, the mounting housing member 250 is made or manufactured of a plastic material to allow for magnetic field penetration from the motor assembly 200, without any, or with minimal, magnetic field loss. This allows for a magnet or magnets of smaller size, in comparison to a magnet or magnets needed when the mounting housing member 250 is made or manufactured of a non-plastic material, to be used, and, thus, reducing cost for magnets.

Figure 2:
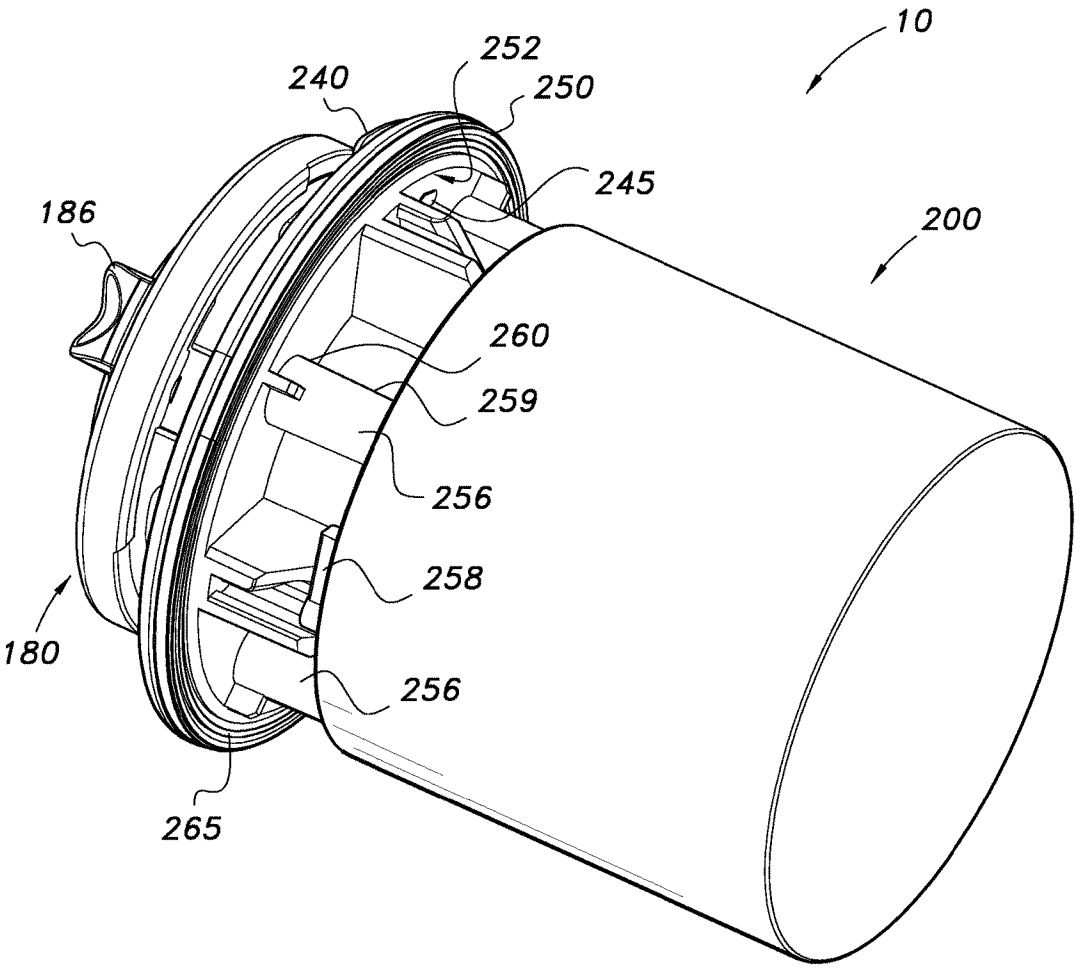
FIG. 2 is a rear, left side, perspective view of the fluid pump of FIG. 1.

As shown in FIG. 2, the gasket or seal 265, preferably a ring-shaped or ring-type gasket, acts or serves as a fluid or water seal to prevent fluid or water from getting past the contact surface of the setting SET and making contact with the motor assembly 200 during use of the fluid pump 10. As shown in FIGS. 3A and 3B, the gasket 265 is secured to and positioned below (or behind) and adjacent to the rear or bottom side 252 of the mounting housing member 250 and above (or in front of) and adjacent to the contact surface of the setting SET. Preferably, the gasket 265 is made or manufactured of a rubber material.

Figure 6:
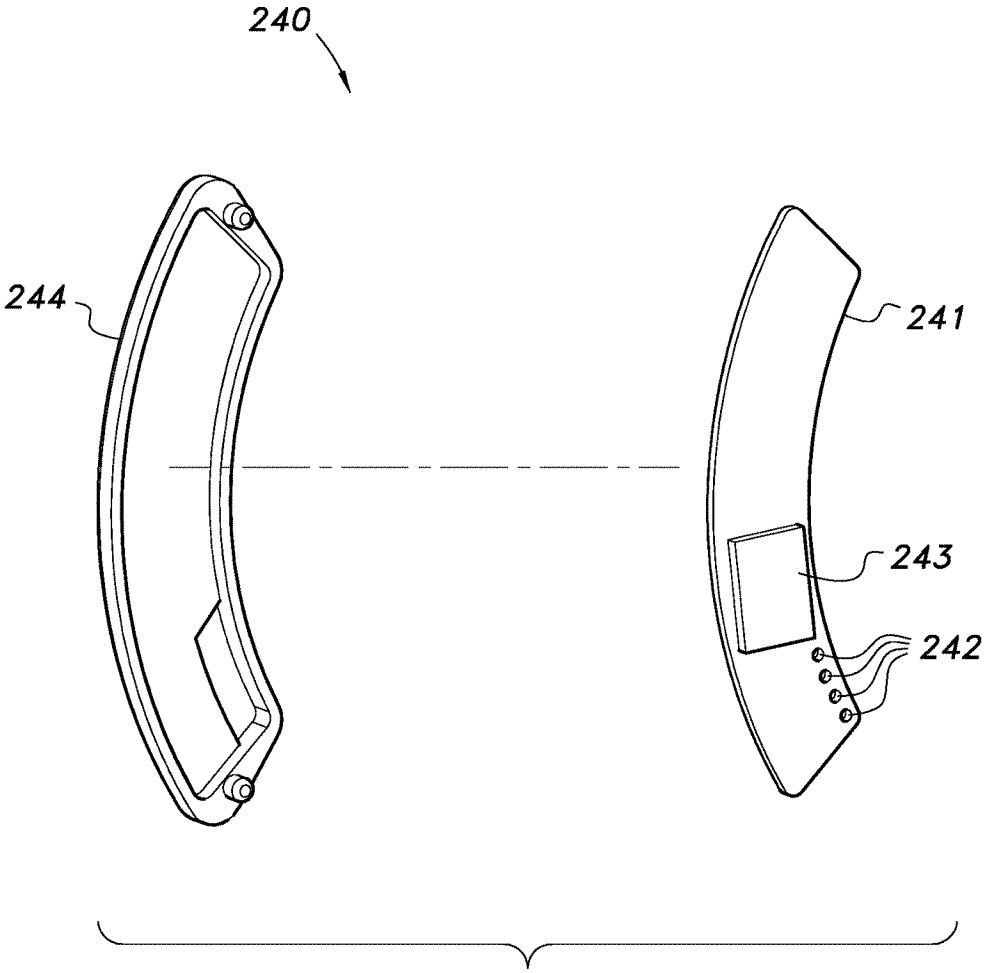
FIG. 6 is a front view of a contactless, fluid sensor assembly according to the present invention.
Figure 7:
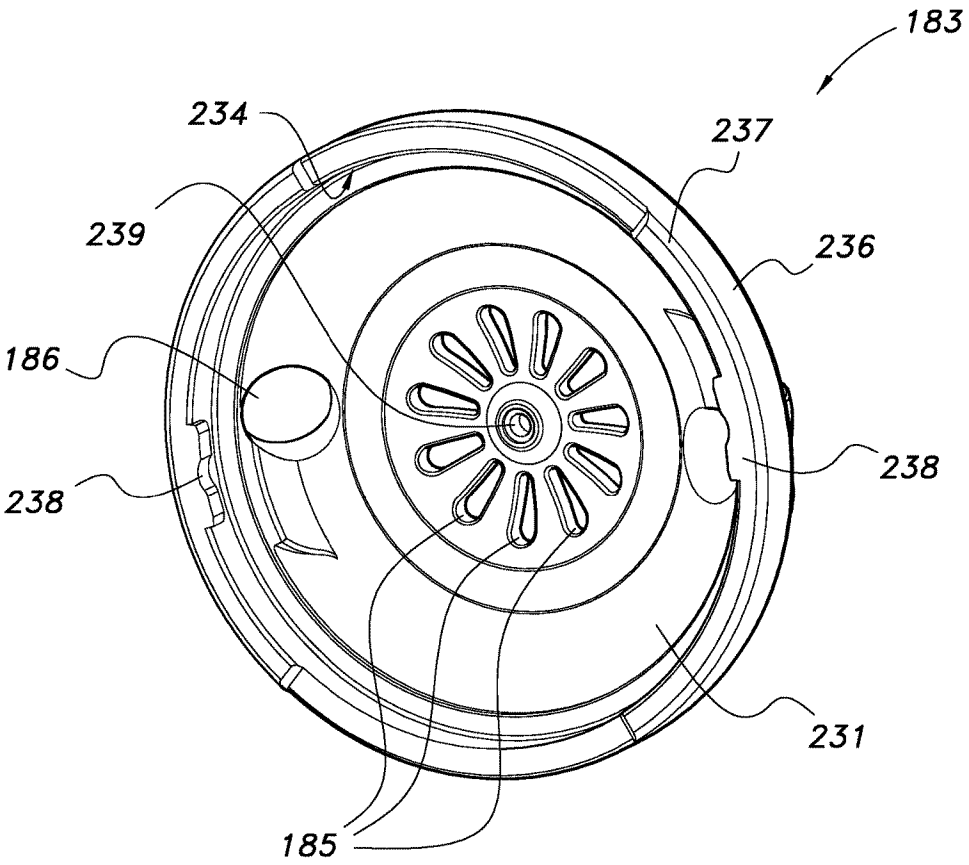
FIG. 7 is a rear, perspective view of a front or top cover of a jet assembly housing according to the present invention, showing an inner surface of the front or top cover.

As a non-limiting example and as best shown in FIGS. 2, 4 and 6, the contactless, fluid sensor assembly 240 includes a contactless, fluid sensor or sensor circuit board 241, a sensor cover 244, and a sensor output data cable or cable connector 245.

The contactless, fluid sensor 241 is secured, attached, fixed or mounted to the sensor-receiving cavity 253 of the mounting housing member 250. Preferably, the contactless, fluid sensor 241 is a contactless, capacitive fluid sensor 241. It is obvious to one of ordinary skill in the art that the contactless, fluid sensor 241 can be secured, attached, fixed or mounted to any position on the other components of the fluid pump 10, such as, but not limited to, the mounting housing member 250 (shown in FIG. 3A), or even be positioned at a location away from the fluid pump 10 (shown in FIG. 3B), that allows the contactless, fluid sensor 241 to be in operative communication with the other components of the fluid pump 10 whereby the contactless, fluid sensor 241 is effective, especially when a liner 290 is being used in or with the setting SET, in capacitive sensing of fluid or water level within the setting SET such that the amount or volume of fluid or water can be controlled. The contactless, fluid sensor 241 preferably includes a plurality of connections 242 for data wiring and an electronic circuit 243 for capacitive sensing of fluid or water level within the setting SET such that the amount or volume of fluid or water within the setting SET can be controlled when a liner 290 is being used within the setting SET. When in use or operation, a liner 290 is positioned behind the base 182 of the jet assembly housing 181 and in front of the contactless, fluid sensor 241 such that the liner 290 prevents the fluid within the setting SET from making contact with the contactless, fluid sensor 241.

The sensor cover 244 is secured, attached, fixed or mounted to the contactless, fluid sensor 241, and provides protection for the contactless, fluid sensor 241 against fluid or water, chemicals, substances, etc. that are present in the setting SET. Preferably, the sensor cover 244 is dimensioned and configured to cover all or substantially all of the contactless, fluid sensor 241. Preferably, the sensor cover 244 is made or manufactured of a non-metal material.

The sensor output data cable or cable connector 245 operatively connects with, or is in operative communication with, the plurality of connections 242 for data wiring of the contactless, fluid sensor 241 through the hole or opening 254 of the sensor-receiving cavity 253.

As a non-limiting example and as best shown in FIGS. 3A and 3B, the liner 290, preferably a disposable liner 290, may be included with the fluid pump 10 or may be provided by an operator or user of the setting SET. The liner 290 is positioned between the base 182 of the jet assembly housing 181 and the mounting housing member 250, with the contactless, fluid sensor 241 being secured, attached, fixed or mounted to the mounting housing member 250, such that the fluid or water, chemicals, substances, etc. that are present in the setting SET do not make contact with the contactless, fluid sensor 241. The liner 290 helps to provide proper or adequate hygiene for customers or users. Preferably, the disposable liner 290 is made or manufactured of a plastic material or any other material known to one of ordinary skill in the art. If the liner 290 is not a disposable version, then it is preferred that the liner 290 is made or manufactured of a material that is easily washed or cleaned, or any other material known to one of ordinary skill in the art.

Figure 19:
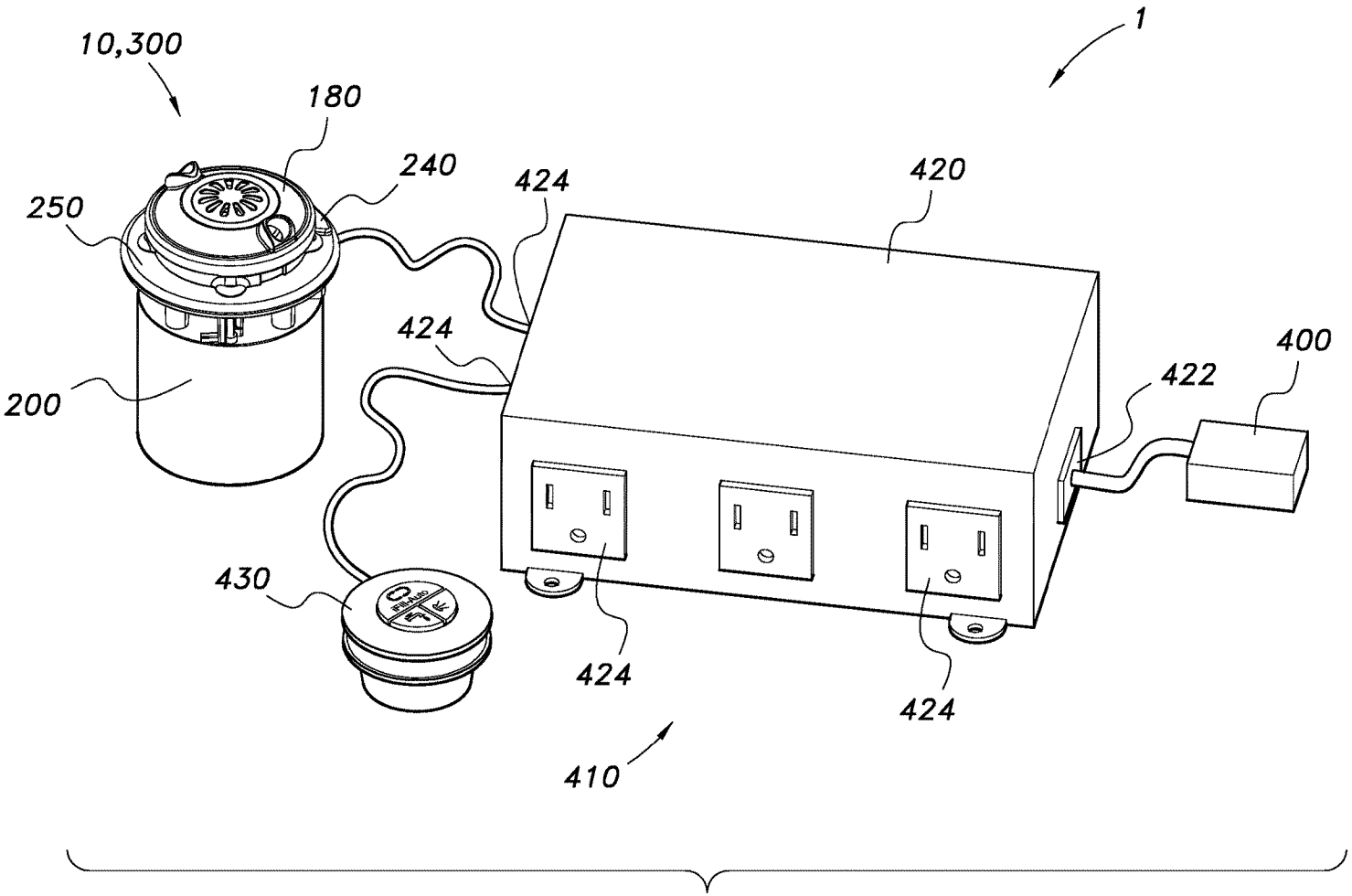
FIG. 19 is a perspective view of a fluid pump apparatus according to the present invention, showing a fluid pump and a control device or keypad being connected to a control box.
Figure 20:
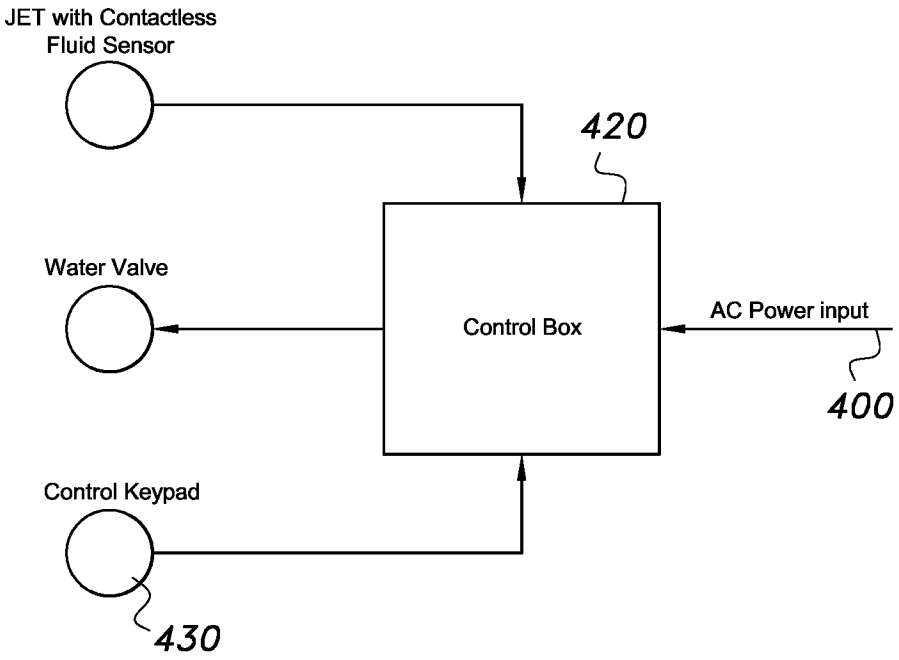
FIG. 20 is a schematic view of a control box according to the present invention, showing the control box being in operative connection or communication with a fluid pump, a control device or keypad, a fluid valve, and a power source.

As shown in FIGS. 19 and 20, the power source 400 provides power to the fluid pump 10,300, and preferably provides power to the motor 202 of the motor assembly 200 of the fluid pump 10,300 to drive the impeller 170. As a non-limiting example, the power source 400 may be AC power input, at least one battery, or any power source known to one of ordinary skill in the art. As shown in FIGS. 19 and 20, the motor 202 may be connected to the power source 400 via the control box 420 of the control apparatus 410.

As shown in FIGS. 19 and 20, the control apparatus 410 preferably includes the control box 420 and a control keypad or device 430. The control box 420 preferably includes at least one inlet 422 for being in operative communication with the power source 400, and multiple outlets 424 for being in operative communication with the fluid pump 10,300 and control keypad or device 430. The control keypad or device 430 preferably acts as a remote control device to be able to turn the fluid pump 10,300 on and off, to adjust how much fluid the fluid or water valve should allow to be added into and/or to be removed or drained from the setting SET, etc. In addition, it is preferred that the control keypad or device 430 is operable to control at least one of the intensity, color, illumination sequencing, and any combination thereof for the array of LED light members 275.

Figure 21:
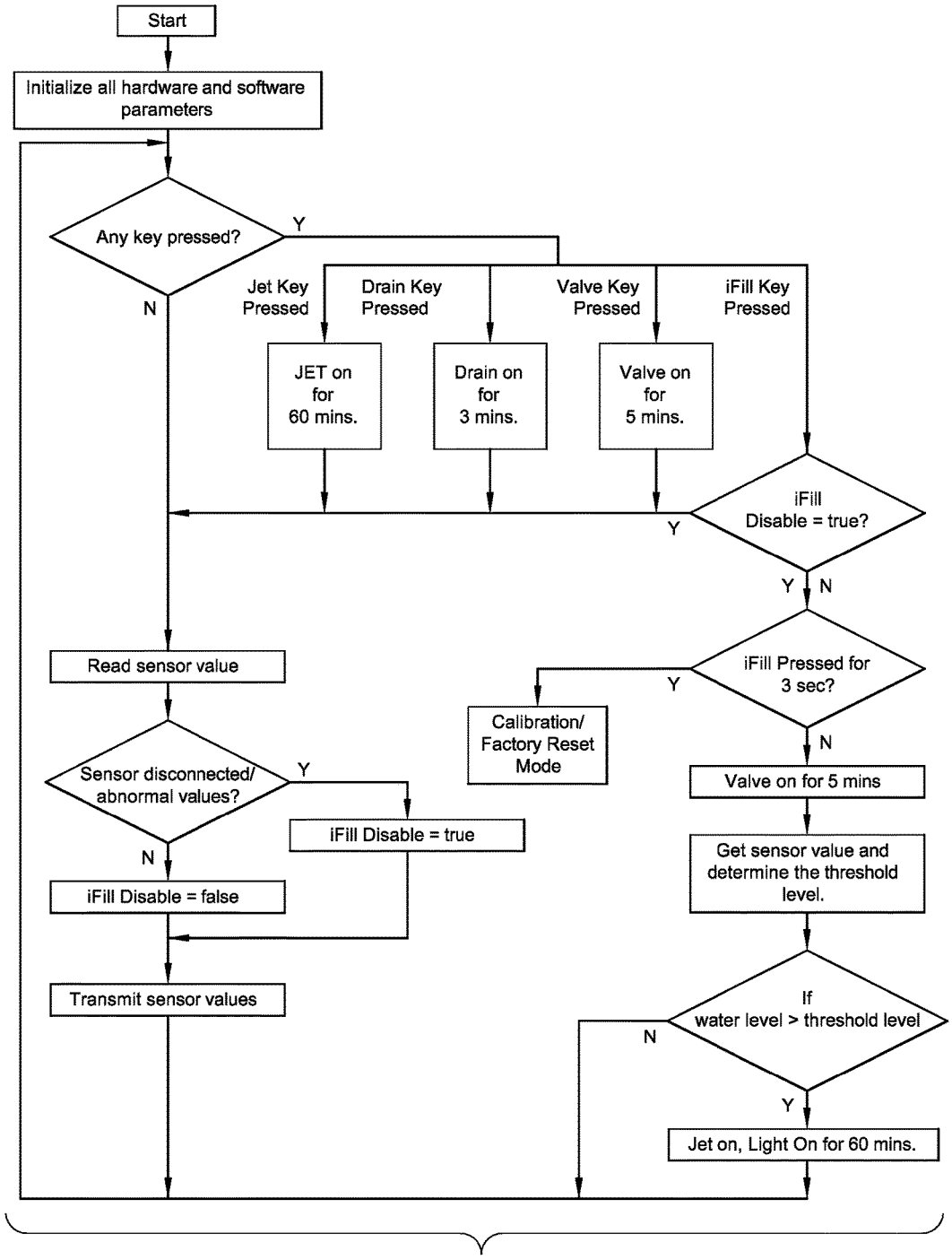
FIG. 21 is a schematic block diagram of an embodiment of controlling fluid or water level in a setting via the use of a fluid pump having a contactless, fluid sensor according to the present invention, showing the relationships or associations of various components, such as a control keypad or device being in operative connection or communication with the fluid pump, a control box, a fluid valve, and a power source.

FIG. 21 shows a schematic block diagram of an embodiment of controlling fluid or water level in a setting via the use of a fluid pump 10,300 having a contactless, fluid sensor 241 according to the present invention, showing the relationships or associations of various components, such as the control keypad or device 430 being in operative connection or communication with the fluid pump 10,300, the control box 420, a fluid valve, and the power source 400.

As best shown in FIGS. 8-14, the bearing and shaft assembly 100 is comprised of a bearing assembly 110 comprising at least an outer bearing member 120 and an inner bearing member 130, and a shaft assembly 140 comprising a shaft member 150, a shaft protection member 160, and a locking mechanism 159.

As shown in FIGS. 11-14, the outer bearing member 120 and inner bearing member 130 perform as a bearing. The inner bearing member 130 absorbs vibration and noise when in use with other components of the jet assembly 180,180'.

Figure 13:
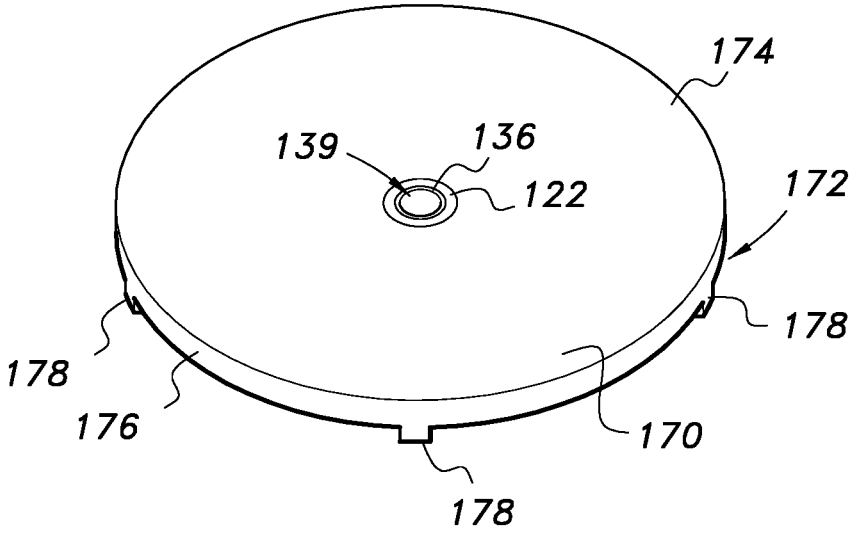
FIG. 13 is an assembly, perspective view of the bearing assembly of FIG. 11 positioned within a cavity of an impeller.

The outer bearing member 120 includes a base 122, preferably a ring-like base, and a cylindrical body 124 extending upwardly from the ring-like base 122. The ring-like base 122 has a predetermined thickness. The cylindrical body 124 has a first end 126, a second end 128, and a cavity 129 extending from the first end 126 to the second end 128. As shown in FIGS. 11-14, the cavity 129 is dimensioned and configured for receiving the inner bearing member 130. Preferably, when in use, the outer bearing member 120 and inner bearing member 130 are closely or tightly positioned relative to one another such that they form an effective seal. As shown in FIGS. 13 and 14, the outer bearing member 120 is dimensioned and configured for fitting, preferably closely or tightly fitting, within a centrally-disposed cavity 179 of the impeller 170, preferably a magnetic impeller and more preferably a planar magnetic impeller, of the jet assembly 180,180'. Preferably and as best shown in FIG. 13, the ring-like base 122 of the outer bearing member 120 and first end 136 of the cylindrical body 134 of the inner bearing member 130 are substantially flush with the rear side 174 of the magnetic impeller 170 when the outer bearing member 120 and inner bearing member 130 are positioned within the centrally-disposed cavity 179 of the magnetic impeller 170. Preferably, the centrally-disposed cavity 179 of the magnetic impeller 170 is dimensioned and configured for effectively receiving the bearing assembly 110 prior to use, and also for effectively retaining the bearing assembly 110 when in use. The outer bearing member 120 is preferably made or manufactured of a plastic material or engineered plastics. It is obvious to one of ordinary skill in the art that other suitable materials may be used in the making or manufacturing of the outer bearing member 120.

The inner bearing member 130 includes cylindrical body 134 having first end 136, a second end 138, and a cavity 139 extending from the first end 136 to the second end 138. As shown in FIGS. 11-14, the cavity 139 is dimensioned and configured for receiving the shaft member 150 and shaft protection member 160 of the shaft assembly 140. The inner bearing member 130 is preferably made or manufactured of rubber or a rubber-like material. It is obvious to one of ordinary skill in the art that other suitable materials may be used in the making or manufacturing of the inner bearing member 130.

Figure 10:
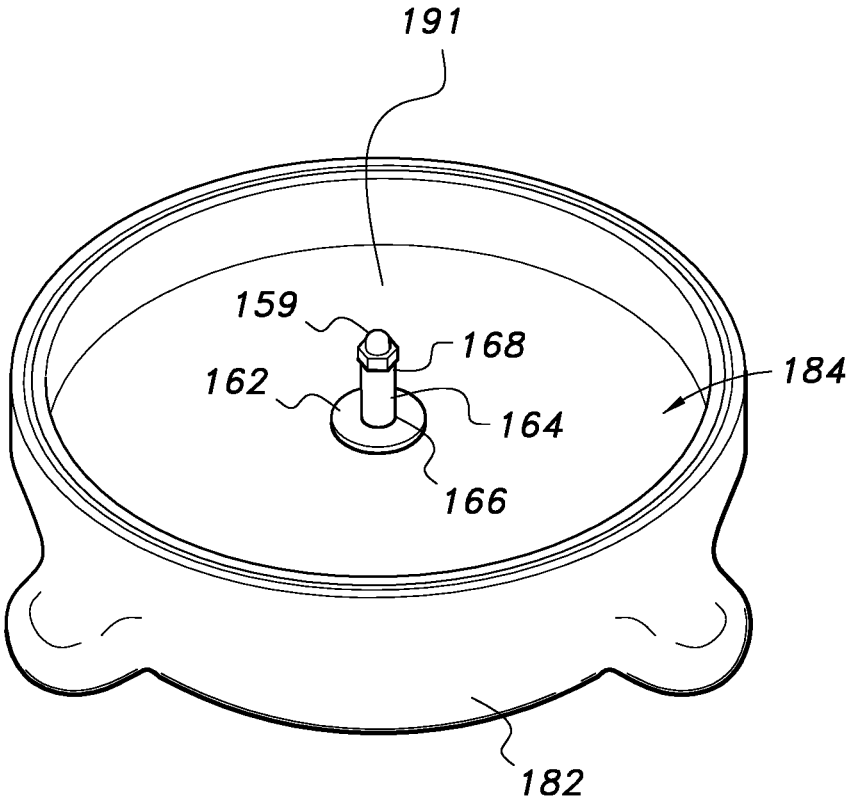
FIG. 10 is an assembly, perspective view of the shaft assembly of FIG. 8 positioned relative to a jet assembly housing (without a front or top cover) of a jet assembly.
Figure 11:
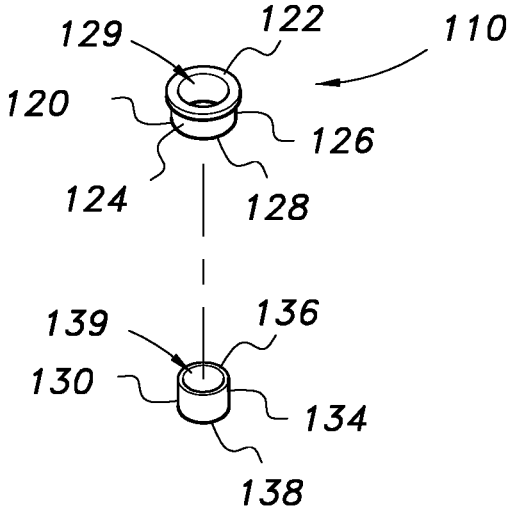
FIG. 11 is an exploded, perspective view of a bearing assembly of a bearing and shaft assembly according to the present invention.
Figure 12:
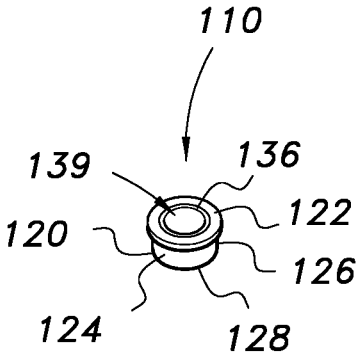
FIG. 12 is an assembly, perspective view of the bearing assembly of FIG. 11.

As shown in FIGS. 8-10 and 14, the shaft member 150 includes a base 152 and a cylindrical body 154 extending upwardly from the base 152. The cylindrical body 154 has a first end 156 and a second end 158. As best shown in FIG. 10, the shaft member 150 and shaft protection member 160 are secured, attached, fixed or mounted within the housing 181, preferably in a central location upon the inner surface 191 of the base 182 of the housing 181, of the jet assembly 180,180' via the base 152 of the shaft member 150 being secured, attached, fixed or mounted to the base 182 of the housing 181. The cylindrical body 154 has a first end 156 and a second end 158. The shaft member 150 is preferably made or manufactured of steel or a metal material. It is obvious to one of ordinary skill in the art that other suitable materials may be used in the making or manufacturing of the shaft member 150. Also, the shaft member 150 is preferably made or manufactured as a single piece. It is obvious to one of ordinary skill in the art that the shaft member 150 may be made or manufactured as multiple pieces.

The shaft protection member 160 includes a base 162, preferably a ring-like base, and a cylindrical body 164 extending upwardly from the ring-like base 162. The cylindrical body 164 has a first end 166, a second end 168, and a cavity 169 extending from the first end 166 to the second end 168. As shown in FIG. 8, the cavity 169 is dimensioned and configured for receiving the cylindrical body 154 of the shaft member 150. The shaft protection member 160 is preferably made or manufactured of a hard material, such as ceramic or a ceramic-type material. It is obvious to one of ordinary skill in the art that other suitable materials may be used in the making or manufacturing of the shaft protection member 160. Also, the shaft protection member 160 is preferably polished or super smooth on its outer surface. Further, the shaft protection member 160 is preferably made or manufactured as two pieces. It is obvious to one of ordinary skill in the art that the shaft protection member 160 may be made or manufactured as a single piece.

The locking mechanism 159 secures the shaft protection member 160 within the housing 181 of the jet assembly 180,180'. The locking mechanism 159 may be a locking nut that, when in use, is secured onto the second end 158 of the cylindrical body 154 of the shaft member 150.

Figure 17:
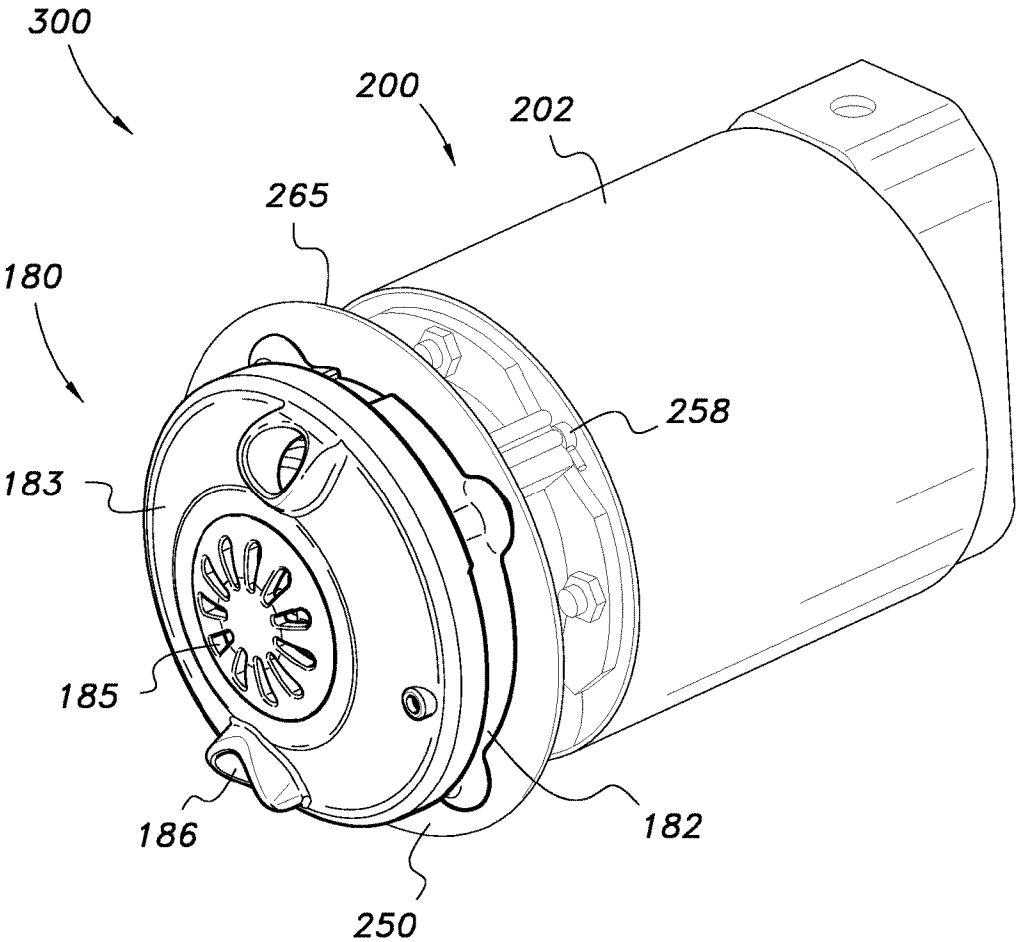
FIG. 17 is a perspective view of a magnetic, coupling-type pump according to the present invention, showing a jet assembly and a motor assembly secured or coupled to or about one another, and not including a contactless, fluid sensor assembly nor a liner.

In addition, when the magnetic coupling-type pump 300 is assembled as shown in FIGS. 17, 18A and 18B, the jet assembly 180' is positioned adjacent or in close proximity to the mounting housing member 250 and motor assembly 200. The jet assembly 180' is preferably magnetically coupled to the motor assembly 200 when the jet assembly 180' is positioned adjacent or in close proximity to the mounting housing member 250. The jet assembly 180' and mounting housing member 250 can be secured or coupled to one another by any method and/or device known to one of ordinary skill in the art.

In operation or use and as shown in FIGS. 5 and 10-14, the base 152 of the shaft member 150 and base 162 of the shaft protection member 160 may be secured, attached, fixed or mounted preferably in a central location upon the inner surface 191 of the base 182 of the housing 181 of the jet assembly 180,180' of the magnetic coupling-type pump 10,300. The bearing assembly 110 may then be positioned in the cavity 179 of the magnetic impeller 170, which can then be positioned within the impeller-receiving chamber 184 of the housing 181 of the jet assembly 180,180'. The locking mechanism or nut 159 can then be secured to the second end 158 of the cylindrical body 154 of the shaft member 150 to align the magnetic impeller 170 within the housing 181 of the jet assembly 180,180'.

Preferably when in operation or use and as shown in FIGS. 17, 18A and 18B, the jet assembly 180,180' is positioned adjacent or in close proximity to the motor assembly 200 when the magnetic coupling-type pump 10,300 is fully assembled. In that regard, the jet assembly 180,180' is preferably magnetically coupled to the motor assembly 200 when the jet assembly 180,180' is positioned adjacent or in close proximity to the motor assembly 200. Specifically, the magnetic pole array 210 of the motor assembly 200 and the magnetic pole array 177 of the jet assembly 180,180' magnetically couple together the motor assembly 200 and the jet assembly 180,180'.

Moreover, during operation of the fluid pump 300 and motor assembly 200 as shown in FIGS. 18A and 18B, the shaft member 150 of the shaft assembly 140 is stationary while the motor shaft member 208 of the motor assembly 200 is rotated such that the magnetic field 212 generated by the magnetic pole array 210 of the motor assembly 200 moves or fluctuates in accordance with the rotation of the magnetic pole array 210 of the motor assembly 200. This moving or fluctuating magnetic field 212 moves and/or causes rotation of magnetic pole array 177 of the magnetic impeller 170. Additionally, as discussed in greater detail below, rotation of the magnetic impeller 170 results in fluid being drawn towards the magnetic impeller 170 through inlet apertures 185 and such fluid to be propelled out of the jet assembly 180,180' through the outlet aperture 186.

In a further exemplary aspect, the present invention is directed to a method for dispensing a fluid to a setting using a fluid pump 10,300 having a contactless, fluid sensor 241 and the fluid pump being for use with a liner 290, the method comprising the steps of:

securing a fluid pump 10,300 to a setting SET, wherein the fluid pump 10,300 comprises a motor assembly 200 comprising a motor 202, a jet assembly 180,180' secured to or about the motor assembly 200, and a contactless, fluid sensor assembly 240 comprising a contactless, fluid sensor 241, wherein the jet assembly 180,180' is in operative communication with the motor 202, wherein the jet assembly 180,180' comprises a jet assembly housing 181, a shaft member assembly, and an impeller 170 having an outer diameter, wherein the jet assembly housing 181 comprises a base 182, a top cover 183, an impeller-receiving chamber 184 defined by the base 182 and the top cover 183, at least one inlet aperture 185, and at least one outlet aperture 186, wherein the base 182 of the jet assembly housing 181 comprises an inner surface 191 and an outer surface 192, wherein the top cover 183 of the jet assembly housing 181 comprises an inner surface 231 and an outer surface 232, wherein the shaft member assembly comprises a shaft member 150 secured to the base 182 of the jet assembly housing 181, wherein the at least one inlet aperture 185 is disposed about the housing 181 and is dimensioned and configured to allow a fluid to enter the jet assembly housing 181 when in operation, wherein the at least one outlet aperture 186 is disposed about the housing 181 and is dimensioned and configured to allow the fluid to exit from the jet assembly housing 181 and enter a setting SET when in operation, wherein the impeller-receiving chamber 184 is dimensioned and configured to receive the impeller 170 and to allow the impeller 170 to rotate about the shaft member 150 within the impeller-receiving chamber 184, and wherein the impeller 170 is caused by the motor 202 to rotate within the impeller-receiving chamber 184 when in operation, wherein the rotation of the impeller 170 causes a first fluid to enter the jet assembly housing 181 via the at least one inlet aperture 185 and to exit the jet assembly housing 181 via the at least one outlet aperture 186;

securing a liner 290 to the fluid pump 10,300 (preferably), or the setting SET, wherein the contactless, fluid sensor 241 is secured at a predetermined location on the fluid pump 10,300 that is rearward of both the jet assembly 180,180' and the liner 290 being used within the setting SET such that the contactless, fluid sensor 241 does not make contact with a fluid when in operation, wherein the contactless, fluid sensor 241 is able to detect a fluid level in the setting SET such that the amount or volume of fluid within the setting SET can be controlled;

causing rotation of the impeller 170 about the shaft member assembly and positioned within the impeller-receiving chamber 184 defined by the housing 181 of the jet assembly 180,180';

allowing the fluid to enter the housing 181 of the jet assembly 180,180' through the at least one input aperture 185 disposed about the housing 181 of the jet assembly 180,180';

disturbing the entered fluid with the rotating impeller 170; and dispensing the entered fluid through the at least one output aperture 186 disposed about the housing 181.

In addition, the method above may further include: wherein the shaft member assembly is a bearing and shaft assembly 100 that is comprised of a bearing assembly 110 comprising an outer bearing member 120 and an inner bearing member 130, and a shaft assembly 140 comprising a shaft member 150, a shaft protection member 160, and a locking mechanism 159.

Furthermore, the method above may further include:

wherein the outer bearing member 120 further comprises a base 122 comprising a cavity, wherein the cylindrical body 124 of the outer bearing member 120 extends upwardly from the base 122, wherein the cavity of the base 122 is dimensioned and configured for receiving the inner bearing member 130, wherein the shaft member 150 further comprises a base 152, wherein the cylindrical body 154 of the shaft member 150 extends upwardly from the base 152 of the shaft member 150, and wherein the shaft protection member 160 further comprises a base 162 comprising a cavity, wherein the cylindrical body 164 of the shaft protection member 160 extends upwardly from the base 162 of the shaft protection member 160, and wherein the cavity of said base 162 is dimensioned and configured for receiving the shaft member 150.

Additionally, the method above may further include:

wherein the jet assembly 180,180' is adapted for being secured to a fluid pump 10,300, such as a magnetic coupling pump 10,300 and the like, wherein the impeller 170 is a magnetic impeller 170 comprising a magnetic pole array 177, wherein a motor assembly 200 of the magnetic coupling pump 300 comprises a motor 202, a magnetic pole array 210, and a motor shaft member 208 adapted for being rotated such that a magnetic field 212 generated by the magnetic pole array 210 of the motor assembly 200 moves or fluctuates in accordance with the rotation of the magnetic pole array 210 of the motor assembly 200, wherein the motor 202 drives the magnetic pole array 210 of the motor assembly 200, wherein the magnetic field 212 moves and/or causes rotation of the magnetic pole array 177 of the magnetic impeller 170, and wherein rotation of the magnetic impeller 170 results in the fluid being drawn towards the magnetic impeller 170 through the at least one inlet aperture 185 and the fluid to be propelled out of the jet assembly 180,180' through the at least one outlet aperture 186.

Further, the method above may further include:

wherein the outer bearing member 120 is manufactured of a plastic material or engineered plastics, wherein the inner bearing member 130 is manufactured of rubber or a rubber-like material, wherein the shaft member 150 is manufactured of steel or a metal material, and wherein the shaft protection member 160 is manufactured of a hard material.

Furthermore, the method above may further include any of the parts, steps and/or details that have been described in the above paragraphs with regard to the improved bearing and shaft assembly 100, jet assemblies 180,180', and fluid pumps 10,300, such as magnetic coupling pumps 10,300 and the like.

It is to be understood that the present invention is not limited to the embodiments described above or as shown in the attached figures, but encompasses any and all embodiments within the spirit of the invention.

What is claimed is:

1. A combination jet assembly and mounting housing member apparatus of a magnetic coupling fluid pump for dispensing a fluid to a setting or work environment in manicure and pedicure industries, said combination jet assembly and mounting housing member apparatus comprising:

a jet assembly comprising a bearing assembly, a shaft assembly, a jet assembly housing, and an impeller, wherein said bearing assembly comprises at least one bearing member, wherein said shaft assembly comprises a shaft member, wherein said shaft member extends through an inner surface of said jet assembly housing, wherein said jet assembly housing comprises said inner surface, an outer surface, a base, a top cover, an impeller-receiving chamber, at least one inlet aperture, and at least one outlet aperture, wherein said base of said jet assembly housing is a unitary structure, wherein said base of said let assembly housing is enclosed during operation and comprises a first locking portion of a locking unit, and wherein said impeller-receiving chamber is defined by said base and said top cover when said base and said top cover are secured to one another;

a mounting housing member comprising a top surface, and a bottom surface, dimensioned and configured to mount to a wall of a basin in the manicure and pedicure industries, wherein said top surface of said mounting housing member comprises a second locking portion of said locking unit, and wherein said jet assembly housing is detachably secured to said top surface of said mounting housing member by magnetic coupling; and said locking unit comprising said first locking portion and said second locking portion for preventing rotation of said jet assembly housing during operation.

2. The combination jet assembly and mounting housing member apparatus according to claim 1, wherein said mounting housing member further comprises a plate and at least one extension, wherein said plate has said top surface and said bottom surface, wherein said at least one extension extends rearward and away from said bottom surface of said plate, and wherein said at least one extension is for securing the motor.

3. The combination jet assembly and mounting housing member apparatus according to claim 1, wherein said locking unit is comprised of at least one locking knob positioned on said outer surface of said base of said jet assembly housing and of at least one locking aperture positioned on said top surface of said mounting housing member, and wherein said at least one locking aperture is dimensioned and configured for receiving said at least one locking knob such that said locking unit is formed when said at least one locking knob and said at least one locking aperture are secured with one another.

4. The combination jet assembly and mounting housing member apparatus according to claim 1, wherein said locking unit is a detachable locking unit.

5. The combination jet assembly and mounting housing member apparatus according to claim 1, wherein said outer diameter of said impeller is equal to or greater than said outer diameter of said at least one inlet aperture.

6. The combination jet assembly and mounting housing member apparatus according to claim 1, wherein an outer surface of said base of said jet assembly housing is adjacent to said top surface of said mounting housing member.

7. The combination jet assembly and mounting housing member apparatus according to claim 1, wherein said mounting housing member further comprises a plurality of mounting legs.

8. The combination jet assembly and mounting housing member apparatus according to claim 7, wherein at least one mounting leg of said plurality of mounting legs is dimensioned and configured for receiving a wing nut.

9. The combination jet assembly and mounting housing member apparatus according to claim 1, wherein said shaft assembly further comprises a shaft protection member that comprises a base, wherein said base of said shaft protection member is dimensioned and configured such that it does not extend through said bearing assembly, and wherein said at least one bearing member is dimensioned and configured such that a first end of said at least one bearing member is rotated above a top surface of said base of shaft protection member during operational use.

10. A combination jet assembly and mounting housing member apparatus of a magnetic coupling fluid pump for dispensing a fluid to a setting or work environment in manicure and pedicure industries, said combination jet assembly and mounting housing member apparatus comprising:

a jet assembly comprising a bearing assembly, a shaft assembly, a jet assembly housing, and an impeller, wherein said bearing assembly comprises at least one bearing member, wherein said shaft assembly comprises a shaft member and a shaft protection member, wherein said shaft member extends through an inner surface of said jet assembly housing, wherein said shaft protection member comprises a base, and wherein said base of said shaft protection member is dimensioned and configured such that it does not extend through said bearing assembly, wherein said jet assembly housing comprises said inner surface, an outer surface, a base, a top cover, an impeller-receiving chamber, at least one inlet aperture, and at least one outlet aperture, wherein said base of said jet assembly housing is a unitary structure, wherein said base of said let assembly housing is enclosed during operation, and wherein said impeller-receiving chamber is defined by said base and said top cover when said base and said top cover are secured to one another; and a mounting housing member comprising a top surface, and a bottom surface, dimensioned and configured to mount to a wall of a basin in the manicure and pedicure industries, wherein said jet assembly housing is detachably secured to said top surface of said mounting housing member by magnetic coupling, and wherein said top surface of said mounting housing member comprises a generally flat section that is at least 10% of said top surface for accommodating a liner being positioned between said base of said jet assembly housing and said top surface of said mounting housing member.

11. The combination jet assembly and mounting housing member apparatus according to claim 10, further comprising a locking unit for securing said jet assembly housing to said mounting housing member to prevent rotation of said jet assembly housing during operation, wherein said base of said jet assembly housing comprises a first locking portion of said locking unit, and wherein said top surface of said mounting housing member comprises a second locking portion of said locking unit whereby said first locking portion and said second locking portion interact with one another during operation to prevent rotation of said jet assembly housing.

12. The combination jet assembly and mounting housing member apparatus according to claim 11, wherein said locking unit is comprised of at least one locking knob positioned on said outer surface of said base of said jet assembly housing and of at least one locking aperture positioned on said top surface of said mounting housing member, and wherein said at least one locking aperture is dimensioned and configured for receiving said at least one locking knob such that said locking unit is formed when said at least one locking knob and said at least one locking aperture are secured with one another.

13. The combination jet assembly and mounting housing member apparatus according to claim 12, wherein said locking unit is a detachable locking unit.

14. The combination jet assembly and mounting housing member apparatus according to claim 11, wherein said locking unit is a detachable locking unit.

15. The combination jet assembly and mounting housing member apparatus according to claim 10, wherein said mounting housing member further comprises a plate and at least one extension, wherein said plate has said top surface and said bottom surface, wherein said at least one extension extends rearward and away from said bottom surface of said plate, and wherein said at least one extension is for securing the motor.

16. The combination jet assembly and mounting housing member apparatus according to claim 10, wherein said outer diameter of said impeller is equal to or greater than said outer diameter of said at least one inlet aperture.

17. The combination jet assembly and mounting housing member apparatus according to claim 10, where said generally flat section is located at about a center of said mounting housing member.

18. The combination jet assembly and mounting housing member apparatus according to claim 10, wherein said at least one bearing member is dimensioned and configured such that a first end of said at least one bearing member is rotated above a top surface of said base of shaft protection member during operational use.

19. A fluid pump for dispensing a fluid to a setting or work environment in manicure and pedicure industries, said fluid pump comprising:

a jet assembly comprising a jet assembly housing and an impeller, wherein said jet assembly housing comprises an inner surface, an outer surface, a base, a top cover, an impeller-receiving chamber, at least one inlet aperture, and at least one outlet aperture, wherein said base of said jet assembly housing is a unitary structure, wherein said base of said jet assembly housing is enclosed during operation and comprises a first locking portion of a locking unit, wherein said impeller-receiving chamber is defined by said base and said top cover when said base and said top cover are secured to one another, wherein said impeller comprises an upper surface, a lower surface, a side surface, an outer diameter, and at least one arm member, wherein said outer diameter of said impeller is equal to or greater than an outer diameter of said at least one inlet aperture, and wherein, when said base and said top cover are secured to one another, a first position is defined at a highest point of said at least one arm member of said impeller, and a second position is defined at a lowest positioned inlet aperture of said at least one inlet aperture on said inner surface of said top cover, and wherein said first position and said second position are spaced less than half of said outer diameter of said impeller;

a mounting housing member comprising a top surface, and a bottom surface, dimensioned and configured to mount to a wall of a basin in the manicure and pedicure industries, wherein said top surface of said mounting housing member comprises a second locking portion of said locking unit, and wherein said jet assembly housing is detachably secured to said top surface of said mounting housing member; by magnetic coupling; and said locking unit comprising said first locking portion and said second locking portion for preventing rotation of said jet assembly housing during operation.

20. The fluid pump according to claim 19, further comprising a bearing assembly, wherein said bearing assembly comprises at least one bearing member.

21. The fluid pump according to claim 19, further comprising a shaft assembly, wherein said shaft assembly comprises a shaft member and a shaft protection member.

22. The fluid pump according to claim 21, wherein said shaft member extends through said inner surface of said jet assembly housing.

23. The fluid pump according to claim 21, wherein said shaft protection member comprises a base.

24. The fluid pump according to claim 19, wherein said top surface of said mounting housing member comprises a generally flat section that is at least 10% of said top surface for accommodating a liner being positioned between said base of said jet assembly housing and said top surface of said mounting housing member.

25. The fluid pump according to claim 19, wherein said locking unit is comprised of at least one knob positioned on said outer surface of said base of said jet assembly.

26. A spa tub in manicure and pedicure industries comprising:

a basin that is configured for mounting a magnetic coupling fluid pump; and said magnetic coupling fluid pump comprising:

a jet assembly comprising a jet assembly housing and an impeller, wherein said jet assembly housing comprises an inner surface, an outer surface, a base, a top cover, an impeller-receiving chamber, at least one inlet aperture, and at least one outlet aperture, wherein said base of said jet assembly housing is a unitary structure, wherein said base of said jet assembly housing is enclosed during operation and comprises a first locking portion of a locking unit, wherein said impeller-receiving chamber is defined by said base and said top cover when said base and said top cover are secured to one another, wherein said impeller comprises an upper surface, a lower surface, a side surface, an outer diameter, and at least one arm member, wherein said outer diameter of said impeller is equal to or greater than an outer diameter of said at least one inlet aperture, and wherein, when said base and said top cover are secured to one another, a first position is defined at a highest point of said at least one arm member of said impeller, and a second position is defined at a lowest positioned inlet aperture of said at least one inlet aperture on said inner surface of said top cover, and wherein said first position and said second position are spaced less than half of said outer diameter of said impeller;

a mounting housing member comprising a top surface, and a bottom surface, dimensioned and configured to mount to a wall of said basin, wherein said top surface of said mounting housing member comprises a second locking portion of said locking unit, wherein said jet assembly housing is detachably secured to said top surface of said mounting housing member by magnetic coupling; and said locking unit comprising said first locking portion and said second locking portion for preventing rotation of said jet assembly housing during operation.

27. The spa tub according to claim 26, wherein said jet assembly further comprises a bearing assembly that comprises at least one bearing member.

28. The spa tub according to claim 26, wherein said jet assembly further comprises a shaft assembly that comprises a shaft member and a shaft protection member.

29. The spa tub according to claim 28, wherein said shaft member extends through said inner surface of said jet assembly housing.

30. The spa tub according to claim 28, wherein said shaft protection member comprises a base.

* * * * *